US010787829B1

(12) United States Patent
Meyer et al.

(10) Patent No.: US 10,787,829 B1
(45) Date of Patent: Sep. 29, 2020

(54) SYSTEMS AND METHODS FOR MANUFACTURED MODULAR CONSTRUCTION

(71) Applicant: MMC-3 Holdings, Richboro, PA (US)

(72) Inventors: Gilbert Meyer, Richboro, PA (US); Ethan Wong, Richboro, PA (US)

(73) Assignee: MMC-3 HOLDINGS, LLC, Richboro, PA (US)

( * ) Notice: Subject to any disclaimer, the term of this patent is extended or adjusted under 35 U.S.C. 154(b) by 0 days.

(21) Appl. No.: 16/556,723

(22) Filed: Aug. 30, 2019

(51) Int. Cl.
*E04H 1/02* (2006.01)
*E04H 1/00* (2006.01)

(52) U.S. Cl.
CPC ..... *E04H 1/02* (2013.01); *E04H 1/005* (2013.01)

(58) Field of Classification Search
CPC ..... E04H 1/005; E04H 1/02; E04H 1/1205; E04B 1/34321; E04B 2/60; E04B 2/58; E04B 2/721; E04B 2/7453; E04B 2/7836; E04B 2002/567
See application file for complete search history.

(56) References Cited

U.S. PATENT DOCUMENTS 2,472,930 A 6/1949 Wilkes
4,862,660 A * 9/1989 Raymond ..... E04B 1/0023 52/220.2
5,305,567 A 4/1994 Wittler
6,256,960 B1 * 7/2001 Babcock ..... E04B 1/14 52/281
6,625,937 B1 9/2003 Parker et al.
10,221,568 B2 * 3/2019 Ljubicic Rubio ..... E04C 2/526
(Continued)

FOREIGN PATENT DOCUMENTS

FR 2008328 A1 * 1/1970
WO WO-2014106367 A1 * 7/2014 ..... E04B 2/58
(Continued)

OTHER PUBLICATIONS

Gilbert Meyer, Manufactured Modular Construction—The Next Evolution, MMC-3 Pitch Deck, published on LinkedIn, 2019, 13 pages.
(Continued)

*Primary Examiner* — Christine T Cajilig
(74) *Attorney, Agent, or Firm* — The Marbury Law Group PLLC

(57) ABSTRACT

Systems, methods, and devices of the various embodiments may enable manufactured modular construction. The various embodiment manufactured modular construction systems, methods, and devices may offer a solution to the housing shortage worldwide that is less than half the cost of the cost of current modular buildings. Various embodiments may include interlocking vertical and horizontal elements. Various embodiments may include a locking system pulling upper horizontal elements of an embodiment modular building toward lower horizontal elements and/or a foundation or a lower floor of the embodiment modular building to thereby lock vertical elements and vertical panels in place between the upper horizontal elements and the lower horizontal elements, foundation, and/or lower floor. In various embodiments, the locking system may include a shock absorber.

43 Claims, 33 Drawing Sheets

(56) References Cited

U.S. PATENT DOCUMENTS

| | | | | |
|---|---|---|---|---|
| 2002/0026766 | A1* | 3/2002 | Wooster | E04B 2/58 52/741.1 |
| 2007/0094963 | A1* | 5/2007 | McDonald | E04B 5/14 52/270 |
| 2010/0083601 | A1* | 4/2010 | Glazik | E04B 2/7453 52/481.1 |
| 2015/0101263 | A1* | 4/2015 | Price | E04B 1/34315 52/79.1 |
| 2019/0186129 | A1* | 6/2019 | Hauserman-Winder | E04G 21/243 |
| 2019/0383013 | A1* | 12/2019 | Jarvie | E04C 2/20 |

FOREIGN PATENT DOCUMENTS

| | | | | |
|---|---|---|---|---|
| WO | WO-2014176710 | A1 * | 11/2014 | E04B 1/3483 |
| WO | WO-2019195874 | A1 * | 10/2019 | E04B 1/34321 |

OTHER PUBLICATIONS

Gilbert Meyer, "Affordable Housing Redefined", Manufactured Modular Construction, MMC-3, published on LinkedIn, https://www.linkedin.com/pulse/affordable-housing-redefined-gilbert-meier, Sep. 21, 2018, 4 pages.

* cited by examiner

SYSTEMS AND METHODS FOR MANUFACTURED MODULAR CONSTRUCTION

SUMMARY

Systems, methods, and devices of the various embodiments may enable manufactured modular construction.

Various embodiments may provide a modular building, comprising: at least one lower horizontal element; at least one vertical element configured to form a hollow central portion; at least one upper horizontal element; and at least one locking system connecting the lower horizontal element, the vertical element, and the upper horizontal element together.

Various embodiments may provide a locking system for a modular building, comprising: a shock absorber; and a locking element connected to the shock absorber, wherein the shock absorber and locking element together connect an upper element of the modular building to a foundation or a lower horizontal element of the modular building and pull the upper element toward the foundation or the lower horizontal element to thereby lock a vertical element and/or a vertical panel in place between the upper element and the foundation or the lower horizontal element. In various embodiments, the upper element may be an upper horizontal element of the modular building.

Various embodiments may provide a method of installing a modular building, comprising: affixing at least one lower horizontal element to a foundation; sliding a vertical element configured to form a hollow central portion over a first raised portion of the lower horizontal element; sliding a vertical panel over a second raised portion of the lower horizontal element and over a raised surface element of the vertical element; sliding an upper horizontal element into the vertical element and the vertical panel; affixing a locking system between the lower horizontal element and the upper horizontal element; and tensioning the locking system to pull the lower horizontal element, the vertical element, and the upper horizontal element together.

Various embodiments may provide a modular building kit, comprising: at least one lower horizontal element; at least one vertical element configured to form a hollow central portion; at least one upper horizontal element; and at least one locking system configured to connect the lower horizontal element, the vertical element, and the upper horizontal element together.

Various embodiments may provide a modular building, comprising: means for affixing at least one lower horizontal element to a foundation; means for sliding a vertical element configured to form a hollow central portion over a first raised portion of the lower horizontal element; means for sliding a vertical panel over a second raised portion of the lower horizontal element and over a raised surface element of the vertical element; means for sliding an upper horizontal element into the vertical element and the vertical panel; means for affixing a locking system between the lower horizontal element and the upper horizontal element; and means for tensioning the locking system to pull the lower horizontal element, the vertical element, and the upper horizontal element together.

BRIEF DESCRIPTION OF THE DRAWINGS

The accompanying drawings, which are incorporated herein and constitute part of this specification, illustrate example aspects of the claims, and together with the general description given above and the detailed description given below, serve to explain the features of the claims.

DETAILED DESCRIPTION

Figure 1A:
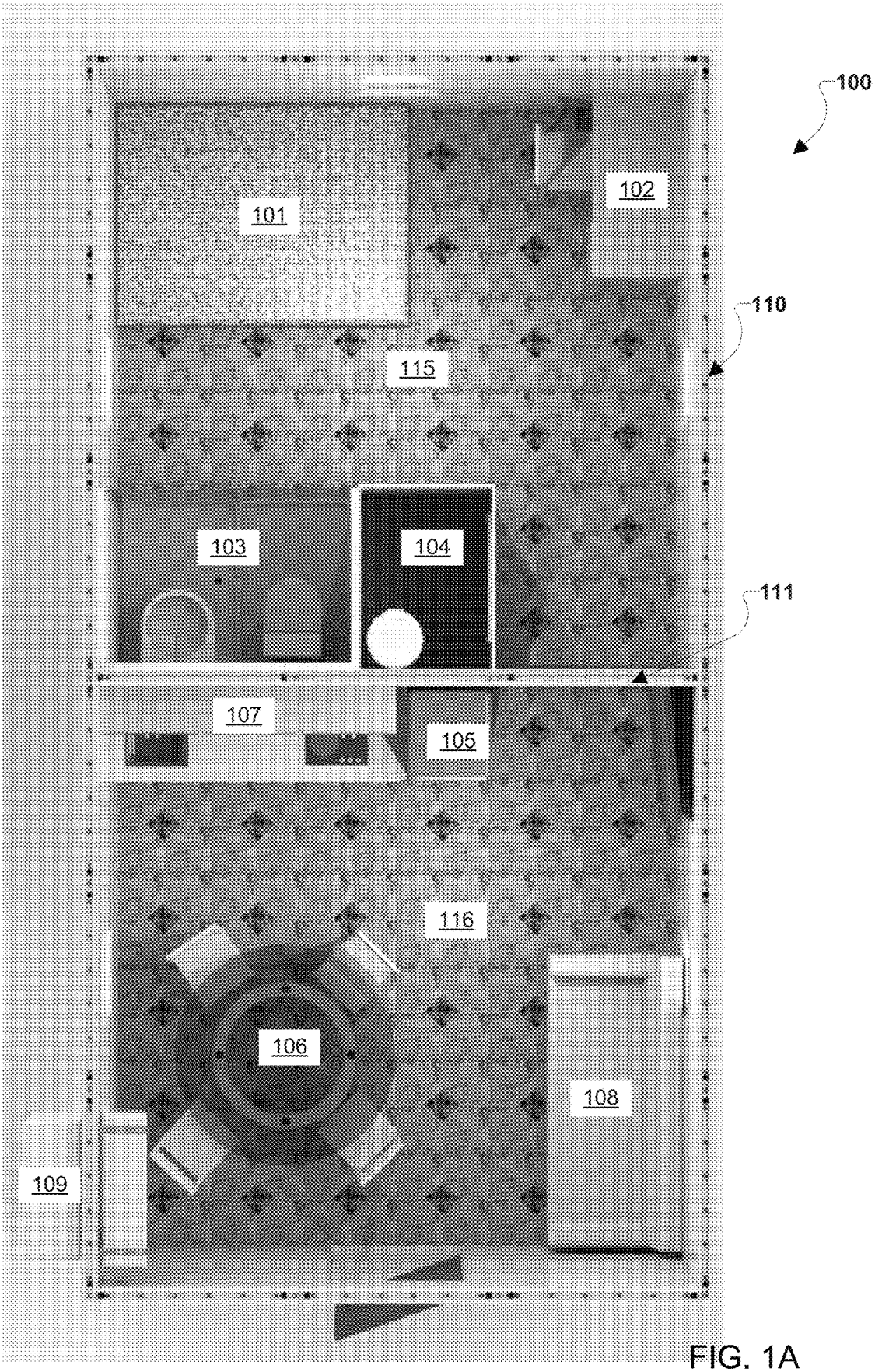
FIG. 1A illustrates a floor plan of a modular building according to various embodiments.

The various aspects will be described in detail with reference to the accompanying drawings. Wherever possible, the same reference numbers will be used throughout the drawings to refer to the same or like parts. References made to particular examples and implementations are for illustrative purposes, and are not intended to limit the scope of the claims. As used herein terms such as "vertical", "horizontal", "upper", "lower", "foundation", "roof", "wall", "over", "under", etc., are used as typically used in the construction industry to relate to an orientation of a building constructed on level ground, such as the orientation of a building as shown in FIG. 1D.

Affordable housing developers are facing more obstacles to building new projects, even though the need for affordable housing grows stronger every year. In the United States (U.S.), the Federal Low-Income Housing Tax Credit (LIHTC) program is providing less funding than it did in prior years, while the cost of construction is getting more expensive. Specifically, land, labor and material costs continue to rise. As a result, individual development deals that make financial sense are getting harder to find.

In the U.S. market, poor families are having an increasingly difficult time finding an affordable place to live, due to high rents, static incomes and a shortage of housing aid. An estimated 11 million families in the U.S. now pay more than half their income on rent, a number that has grown steadily as the supply of affordable housing shrinks. Similarly, in England, property is unaffordable for one hundred thousand households a year. Almost one hundred thousand households in England are being priced out of the property market each year because of a shortage of affordable homes to rent or buy. Additionally, the government in Germany estimates that there is a need for three hundred and fifty thousand new dwellings per year. The U.S., England, and Germany are merely just three examples, and many more countries worldwide face the same shortage of low income housing.

Commonly, modular buildings are built as a single unit or large component in a factory. These single units and larger components currently used for modular construction are costly to transport to a building site and require large heavy lifting equipment (e.g., a crane, etc.) for installation. The installation of these single units and larger components currently requires a large number of fasteners and is labor intensive. Additionally, current modular buildings are expensive to expand. The cost and labor intensiveness of current modular buildings and their construction techniques has previously prevented modular buildings from being used to address housing shortage worldwide.

Systems, methods, and devices of the various embodiments may enable manufactured modular construction. The various embodiment manufactured modular construction systems, methods, and devices may offer a solution to the housing shortage worldwide that is less than half the cost of the cost of current modular buildings. Additionally, the various embodiment manufactured modular construction systems, methods, and devices may provide labor cost savings in that the various embodiments may enable embodiment modular buildings to be erected in shorter amounts of time than the time required for current modular buildings. Various embodiment manufactured modular construction systems, methods, and devices may provide modular buildings exceeding existing buildings in strength and durability. Various embodiment manufactured modular construction systems, methods, and devices may provide modular buildings having a lower building cost than buildings built using current building technologies. Various embodiment manufactured modular construction systems, methods, and devices may provide modular buildings in which structural elements (e.g., walls, roofs, etc.) are held together without a need for glue or caulk.

Various embodiments may include interlocking vertical and horizontal elements. In various embodiments, the vertical and/or horizontal elements may be extruded, pultruded, cast, or otherwise fabricated elements. In various embodiments, the profiles of the vertical and horizontal elements may interlock together forming vertical and/or horizontal channels for electric, data, plumbing, HVAC (heating, ventilation, and air conditioning), and any other type connections and/or utilities suitable for use in a modular building. In various embodiments, the vertical and/or horizontal elements may be formed from fiber-reinforced plastic (FRP) (also referred to as fiber-reinforced polymer). In various embodiments, the FRP may be colored and/or textured. In various embodiments, the FRP may be a thermal insulator. In various embodiments, panels (e.g., vertical panels, such as door panels, window panels, wall panels, etc. and/or roof panels) may slide into the vertical and/or horizontal elements. In various embodiments, vertical panels (e.g., wall panels, etc.) and/or roof panels may be formed from aluminum composite with a structural foam (e.g., polyethylene foam, etc.). As one example, the aluminum composite may be a layered composite of aluminum sheeting layers adhered to the front and back of a sheet of polyethylene. For example, the vertical panels and/or roof panels may be formed from a foam sandwiched between an aluminum frame. The structural foam may act as an insulator (e.g., an R-38 rated insulator) and a sound absorber. In various embodiments, a roof profile may include an integrated gutter. In various embodiments, the vertical and/or horizontal elements may include raised features that interact with grooves on the panels (e.g., grooves on the vertical panels, such as door panels, window panels, wall panels, etc. and/or grooves on the roof panels) to align the vertical and/or horizontal elements with the adjoining panels as tongue and groove joints. In alternative embodiments, the vertical and/or horizontal elements may include grooves that may interact with raised features on the panels (e.g., grooves on the vertical panels, such as door panels, window panels, wall panels, etc. and/or grooves on the roof panels) to align the vertical and/or horizontal elements with the adjoining panels as tongue and groove joints.

Various embodiments may include a locking system pulling upper horizontal elements of an embodiment modular building toward lower horizontal elements of the embodiment modular building to thereby lock vertical elements and vertical panels in place between the upper horizontal elements and the lower horizontal elements. Various embodiments may include a locking system pulling upper horizontal elements of an embodiment modular building toward the foundation and/or lower floors of the embodiment modular building to thereby lock vertical elements and vertical panels in place between the upper horizontal elements and the foundation and/or lower floors. In various embodiments, the locking system may not require fasteners to connect the vertical elements to the vertical panels of an embodiment modular building. In various embodiments, the locking system may enable an embodiment modular building to be erected or disassembled at a speed faster than the speed at which current modular buildings are assembled/disassembled. In various embodiments, the locking system may include a shock absorber. In various embodiments, the shock absorber may include a rubber block, a hydraulic system, a spring, or any other type shock dampening device. In various embodiments, the locking system may not require glue or caulk to hold the structural elements (e.g., the vertical elements, vertical panels, horizontal elements, roof panels, etc.) of an embodiment modular building together.

Various embodiments may provide modular buildings with multi-floor layouts in various increments. In some embodiments, the increments may be 4.2 foot (ft) (or 1.3 meter (m)) increments. In various embodiments, components of a modular building may be energy efficient. Various embodiments may provide a modular building that may be assembled in two hours or less, such as 1.5 to 2 hours, etc., by unskilled workers without a crane at the building site rather than at a factory. Various embodiments may provide a modular building that may be assembled by two unskilled workers at a rate of 0.5 to 2 minutes (min) per square foot (sqft), such as 1 min per sqft. Various embodiments may provide a modular building that resists fire, water, mold, corrosion, and chemical damage. Various embodiments may provide a modular building that is expandable by adding additional vertical and/or horizontal elements. Various embodiments may provide a modular building that may survive the force of a hurricane. In various embodiments, the heaviest component of the modular building may weigh fifty-five kilograms (kg) (or one hundred and twenty-one pounds (lbs)). Various embodiments may provide a modular building as a kit of components that weight fifty-five kg or less and are assembled at a building site.

Various embodiments may provide a modular building that is a modular housing unit. The modular housing unit may have a foot print of at least 4.1 m×8.1 m (or 13.4 ft×26.5 ft), such as 4.1 to 20 m×8.1 to 30 m, etc. The modular housing unit may provide a living space of at least 30.2 square meters (sq m) (or 325 sqft), such as 325-1000 sqft. The modular housing unit may include a bathroom module having a shower, sink, toilet, and vent. The modular housing unit may include a walk in closet module. The modular housing unit may include a modular kitchen cabinets quick wall connect system. The modular housing unit may include a kitchen sink with faucet. The modular housing unit may include a refrigerator and/or freezer. The modular housing unit may include a stove, such as three or more burner stove. The modular housing unit may include a hot water heater. The modular housing unit may include a split air condition (AC) unit. The modular housing unit may include furniture such as a dining table and chairs, a sofa, a flat screen television mount, a desk and chair(s), etc. The modular housing unit may include a security system.

In some embodiments, a modular building may include a single modular housing unit. In some embodiments, a modular building may include two or more modular housing units. In some embodiments, a modular building unit may be a modular apartment building formed from stacking one or more modular housing unit on another modular housing unit. In such apartment configurations, floor panels may replace the roof panels in all but the upper most modular housing units to thereby provide a floor for each successive stacked modular housing unit. As a specific example, a modular apartment building may include ten modular housing units on a first floor, with ten additional modular housing units on a second floor, and ten additional modular housing units on third floor, thereby creating a three level and thirty unit modular apartment building.

In various embodiments, lower horizontal elements may connect to a foundation, such as a slab foundation, basement foundation, piling foundation, etc. The lower horizontal elements may be connected to the foundation with any type fastener, such as pneumatic driven nails, wedge anchors, screws, adhesives, etc. In various embodiments, the lower horizontal elements may have raised features that interconnect with lower portions (i.e., the portions toward the floor of the modular building when installed) of the vertical panels (such as door panels, window panels, wall panels, etc.). As used herein, "raised features" or "raised elements" may refer to features that extend or protrude out from a surface. As such, the raised features of the lower horizontal elements extend or protrude from a surface of the lower horizontal elements. In various embodiments, an upper portion of the lower horizontal elements (i.e., the portion of the lower horizontal elements that is opposite the foundation side of the lower horizontal elements when installed) may be formed as a tongue structure that inserts into a groove structure of the vertical panels, such as door panels, window panels, wall panels, etc., thereby joining the lower horizontal elements with vertical panels by a tongue and groove type joint. In alternative embodiments, the lower horizontal elements may be formed as the groove structure and the tongue structure may be formed on the vertical panels, such as door panels, window panels, wall panels, etc., thereby joining the lower horizontal elements with vertical panels by a tongue and groove type joint.

In various embodiments, lower horizontal elements may include a raised feature that interconnects with lower portions of the vertical elements (i.e., the portion of the vertical elements toward the floor of the modular building when installed). Vertical elements may be hollow pillars having any suitable horizontal cross sectional shape, such as polygonal (e.g., rectangular, etc.), circular, oval, etc. In various embodiments, an upper portion of the lower horizontal elements (i.e., the portion of the lower horizontal elements that is opposite the foundation side of the lower horizontal elements when installed) may be formed as raised structure (e.g., a tenon structure) that inserts into a center cavity portion (e.g., a mortise structure) of the vertical elements, thereby joining the lower horizontal elements with vertical elements in effect by a mortise and tenon type joint. In various embodiments, the vertical elements may create the height of each level of the modular building. In various embodiments, vertical elements may have different profile shapes depending on the type of joint needed to connect two vertical panels (e.g., door panels, window panels, wall panels, etc.). As examples, some vertical elements may have a profile shape to form a straight wall between two vertical panels (e.g., door panels, window panels, wall panels, etc.), some vertical elements may have a profile shape to form a right angle corner between two vertical panels (e.g., door panels, window panels, wall panels, etc.), some vertical elements may have a profile shape to form a t-shaped corner between three vertical panels (e.g., door panels, window panels, wall panels, etc.), some vertical elements may have a profile shape to form a cross shaped corner between four vertical panels (e.g., door panels, window panels, wall panels, etc.). In various embodiments, the vertical elements may have raised features on their sides that interconnect with side portions (i.e., portions running generally orthogonal to the floor and/or roof when installed) of the vertical panels (such as door panels, window panels, wall panels, etc.). In various embodiments, a side portion of the vertical elements (i.e., the portion of the vertical elements that is generally orthogonal to the floor and/or roof when installed) may be formed as a tongue structure that inserts into a groove structure of the vertical panels, such as door panels, window panels, wall panels, etc., thereby joining the vertical elements with vertical panels by a tongue and groove type joint. In alternative embodiments, a side portion of the vertical elements (i.e., the portion of the vertical elements that is generally orthogonal to the floor and/or roof when installed) may be formed as a groove structure that a tongue structure of the vertical panels, such as door panels, window panels, wall panels, etc., inserts into, thereby joining the vertical elements with vertical panels by a tongue and groove type joint. In various embodiments, at least a portion of a locking system, such as a lock rod, lock cable, shock absorber, and/or any other portion of a locking system, may run through a hollow center portion (or hollow central portion) of the vertical elements. The hollow center portion of a vertical element may run the full vertical length of the vertical element. In various embodiments, no fasteners, glue, or caulk, may be needed to keep the vertical elements in place during assembly of a modular building as the vertical elements may be supported by the raised structure (e.g., a tenon structure) of the horizontal elements that inserts into a center cavity portion (e.g., a mortise structure) of the vertical elements.

In various embodiments, the lower horizontal elements may be configured so as to form slots between the raised features that interconnect with lower portions of the vertical elements (i.e., the portion of the vertical elements toward the floor of the modular building when installed) and the raised features that interconnect with lower portions (i.e., the portions toward the floor of the modular building when installed) of the vertical panels (such as door panels, window panels, wall panels, etc.). The slots formed in the lower horizontal elements may provide a gap between the raised features that aligns with the raised features on the sides of the vertical elements. The slots may enable the vertical elements to slide fully into the horizontal elements.

In various embodiments, a roof truss may be a horizontal element configured similar to the vertical elements. The roof truss may include a hollow center portion that may run the full length of the roof truss. The roof trusses may include raised features on their sides that interconnect with side portions (i.e., portions running generally parallel to the roof when installed) of the roof panels. In various embodiments, a side portion of the roof truss (i.e., the portion of the roof truss that is generally parallel to the roof when installed) may be formed as a tongue structure that inserts into a groove structure of the roof panels, thereby joining roof truss with roof panels by a tongue and groove type joint.

In various embodiments, the vertical panels (such as door panels, window panels, wall panels, etc.) and/or roof panels may be formed from a sandwich of insulating foam (e.g., polyurethane foam, etc.) between aluminum composite sheets. The aluminum composite sheets may be a layered composite sheet of aluminum sheeting layers adhered to the front and back of a sheet of polyethylene. A panel seal may be inserted into the grooves of the vertical panels (such as door panels, window panels, wall panels, etc.) and/or roof panels that join to the vertical elements and/or horizontal elements (e.g., lower horizontal elements, upper horizontal elements, roof trusses, etc.) The panel seal may be formed from a compressible material, such a plastic, rubber, or other type material seal, that may act as a weather seal for the joints of the modular building. The panel seal may form a flexible seal between the vertical panels (such as door panels, window panels, wall panels, etc.) and/or roof panels that join to the vertical elements and/or horizontal elements (e.g., lower horizontal elements, upper horizontal elements, roof trusses, etc.). The panel seal may be affixed to the vertical panels (such as door panels, window panels, wall panels, etc.) and/or roof panels, such as by glue, nails, friction, physical arrangement of the surface of the vertical panels (such as door panels, window panels, wall panels, etc.) and/or roof panels, and/or any element in any other manner. The presence of the panel seal at the joint connection points may eliminate the need for caulking and/or glue in the modular building. The panel seals may be flexible seals having one or more raised flexible features (e.g., lips, wipers, bubbles, etc.) extending from a main body of the panel seal. The raised flexible features (e.g., lips, wipers, bubbles, etc.) may be compressed toward the main body of the panel seal when the vertical panels (such as door panels, window panels, wall panels, etc.), roof panels, vertical elements and/or horizontal elements (e.g., lower horizontal elements, upper horizontal elements, roof trusses, etc.) are joined together and the compression of the raised flexible features (e.g., lips, wipers, bubbles, etc.) may form compression interlocks between the vertical panels (such as door panels, window panels, wall panels, etc.) and/or roof panels that join to the vertical elements and/or horizontal elements (e.g., lower horizontal elements, upper horizontal elements, roof trusses, etc.). In various embodiments, the raised flexible features (e.g., lips, wipers, bubbles, etc.) may be compressed to lie flat against the main body of the panel seal when the structural elements of the modular building (e.g., the vertical panels (such as door panels, window panels, wall panels, etc.), roof panels, vertical elements and/or horizontal elements (e.g., lower horizontal elements, upper horizontal elements, roof trusses, etc.)) are joined together. Additionally, the raised flexible features (e.g., lips, wipers, bubbles, etc.) may mold to the mating surface of the structural elements of the modular building (e.g., the vertical panels (such as door panels, window panels, wall panels, etc.), roof panels, vertical elements and/or horizontal elements (e.g., lower horizontal elements, upper horizontal elements, roof trusses, etc.)) when the structural elements are joined together. The flexibility of the panel seals may compensate for tolerance variations in the profiles of the vertical panels (such as door panels, window panels, wall panels, etc.), roof panels, vertical elements and/or horizontal elements (e.g., lower horizontal elements, upper horizontal elements, roof trusses, etc.), especially when such structural elements of the modular building are formed from FRP. As the vertical panels (such as door panels, window panels, wall panels, etc.), roof panels, vertical elements and/or horizontal elements (e.g., lower horizontal elements, upper horizontal elements, roof trusses, etc.) are joined together, the panel seals may compress (e.g., the raised flexible features (e.g., lips, wipers, bubbles, etc.) may compress toward the main body of the panel seal, and/or the main body of the panel seal may compress) and the compression may provide the required tolerances for the structural elements of the modular building to fit together, as well as may act as a shock absorber between the structural elements. This compression of the panel seals may make the structural elements of the modular building (e.g., the vertical panels (such as door panels, window panels, wall panels, etc.), roof panels, vertical elements and/or horizontal elements (e.g., lower horizontal elements, upper horizontal elements, roof trusses, etc.)) easier to fit together. Additionally, by compensating for tolerance variation in the structural elements of the modular building (e.g., the vertical panels (such as door panels, window panels, wall panels, etc.), roof panels, vertical elements and/or horizontal elements (e.g., lower horizontal elements, upper horizontal elements, roof trusses, etc.)), this compression of the panel seals may prevent modular panels from not fitting together at a build site and needing to be shipped back to a supplier due to not fitting, thereby overcoming the non-fitting problem faced in assembling current modular buildings.

In various embodiments, the grooves of the vertical panels (such as door panels, window panels, wall panels, etc.) and/or roof panels interacting with the raised portions of the vertical elements and/or horizontal elements (e.g., lower horizontal elements, upper horizontal elements, roof trusses, etc.) may form vertical and/or horizontal channels for electric, data, plumbing, HVAC (heating, ventilation, and air conditioning), and any other type connections and/or utilities suitable for use in a modular building. Connections to outside utilities may be made by push connections and/or other type connections to the connections and/or utilities running through the modular building. The presence of the vertical and/or horizontal channels may eliminate the need to make holes in the walls of the modular building for connections and/or utilities.

In various embodiments, upper horizontal elements may be the mirror image of the lower horizontal elements. Said another way, the upper horizontal elements may be inverted lower horizontal elements. For example, the upper horizontal elements may have raised features that interconnect with upper portions (i.e., the portions toward the roof of the modular building when installed) of the vertical panels (such as door panels, window panels, wall panels, etc.). In various embodiments, an lower portion of the upper horizontal elements (i.e., the portion of the upper horizontal elements that is toward the foundation side of the upper horizontal elements when installed) may be formed as a tongue structure that inserts into a groove structure of the vertical panels, such as door panels, window panels, wall panels, etc., or vice-versa, thereby joining the upper horizontal elements with vertical panels by a tongue and groove type joint. As another example, the upper horizontal elements may include a raised feature that interconnects with upper portions of the vertical elements (i.e., the portion of the vertical elements toward the roof of the modular building when installed). In various embodiments, a lower portion of the upper horizontal elements (i.e., the portion of the upper horizontal elements that is opposite the roof side of the upper horizontal elements when installed) may be formed as raised structure (e.g., a tenon structure) that inserts into a center cavity portion (e.g., a mortise structure) of the vertical elements, thereby joining the upper horizontal elements with vertical elements in effect by a mortise and tenon type joint. As a further example, the upper horizontal elements may be configured so as to form slots between the raised features that interconnect with upper portions of the vertical elements (i.e., the portion of the vertical elements toward the roof of the modular building when installed) and the raised features that interconnect with upper portions (i.e., the portions toward the roof of the modular building when installed) of the vertical panels (such as door panels, window panels, wall panels, etc.). The slots formed in the upper horizontal elements may provide a gap between the raised features that aligns with the raised features on the sides of the vertical elements. The slots may enable the upper horizontal elements to slide fully into the vertical elements and the vertical panels (such as door panels, window panels, wall panels, etc.). The upper horizontal elements may trap the vertical elements and the vertical panels (such as door panels, window panels, wall panels, etc.) between the upper horizontal elements and the lower horizontal elements.

In various embodiments, a locking system may hold the vertical elements and the vertical panels (such as door panels, window panels, wall panels, etc.) in place between the upper horizontal elements and the lower horizontal elements. In various embodiments, the locking system may include a multitude of rods or cables that pull the upper horizontal elements toward the lower horizontal elements, thereby locking all in-between components (i.e., the vertical elements and the vertical panels (such as door panels, window panels, wall panels, etc.) in place. In this manner, the locking system may eliminate all common fasteners used in the building industry and reduces the time to erect a modular building. Similarly, the locking system may eliminate the need for glue or caulk to be used to hold structural components (e.g., the vertical elements and the vertical panels (such as door panels, window panels, wall panels, etc.), horizontal elements, roof panels, etc.) together. Additionally, the locking system may enable quick disassembly of a building. In various embodiments, a shock absorbing system may be incorporated into the locking system to increase stress resistance during heavy wind loads, explosions, and/or earthquakes. In various embodiments, the shock absorbing system of the locking system may enable the roof to move and snap back during a negative pressure spike. As such, various embodiments may be flexible increasing the modular building's strength under excessive external forces and an embodiment modular building may pass the 8 pounds-per-square-inch (PSI) blast building standard.

In various embodiments, a roof support may be configured to affix to the upper horizontal elements. The roof support may extend horizontally beyond the upper horizontal elements to support the roof. In various embodiments, roof clamps may affix the roof panels and roof trusses to the roof support and thereby to the external vertical walls of the modular building formed by the joined the vertical elements and the vertical panels (such as door panels, window panels, wall panels, etc.). In various embodiments, a weather seal for the roof section may be formed as a gutter forming a channel to collect rain water.

In various embodiments, a floor support may be configured to affix to the upper horizontal elements. In this manner, the floor support may enable the construction of multi-floor modular buildings. The floor support may be a horizontal element configured to support a floor section and/or lower horizontal elements. In various embodiments, a floor section may be similar in construction to a roof as described herein and the floor section may be supported by a protrusion from the floor support. The floor support may extend horizontally beyond the upper horizontal elements to support the floor. The lower horizontal elements of the next floor of the modular building may be affixed to the floor support. The floor support may separate each floor of the modular building and a roof may be affixed to the top floor using a roof support as described herein rather than another floor support.

Figure 1B:
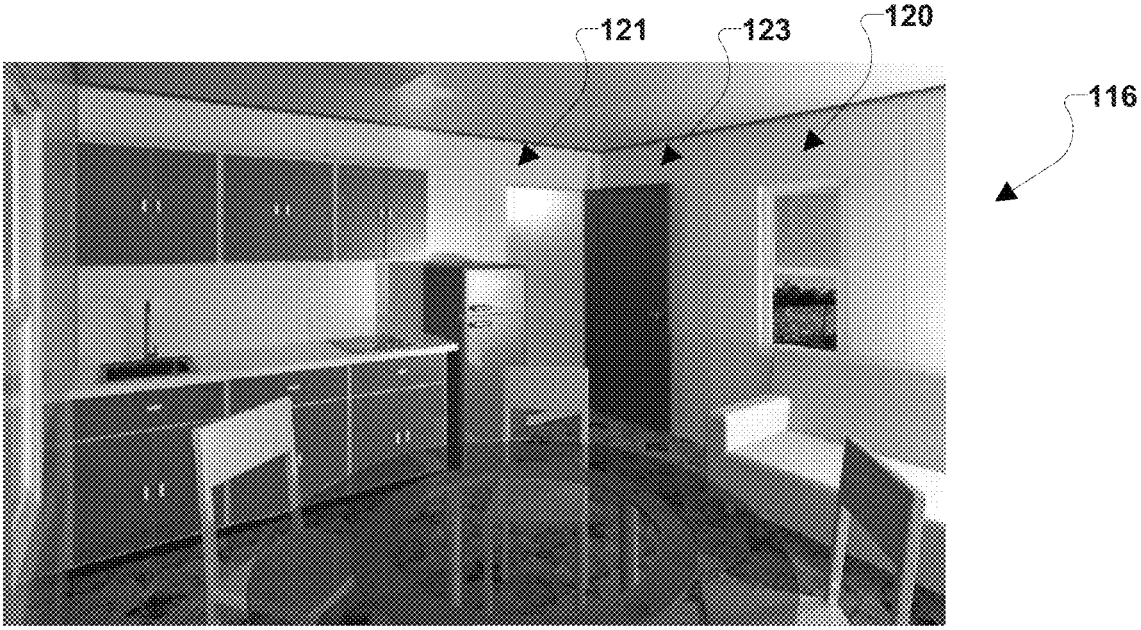
FIGS. 1B and 1C illustrate interior views of rooms of the embodiment module building of FIG. 1A.
Figure 1C:
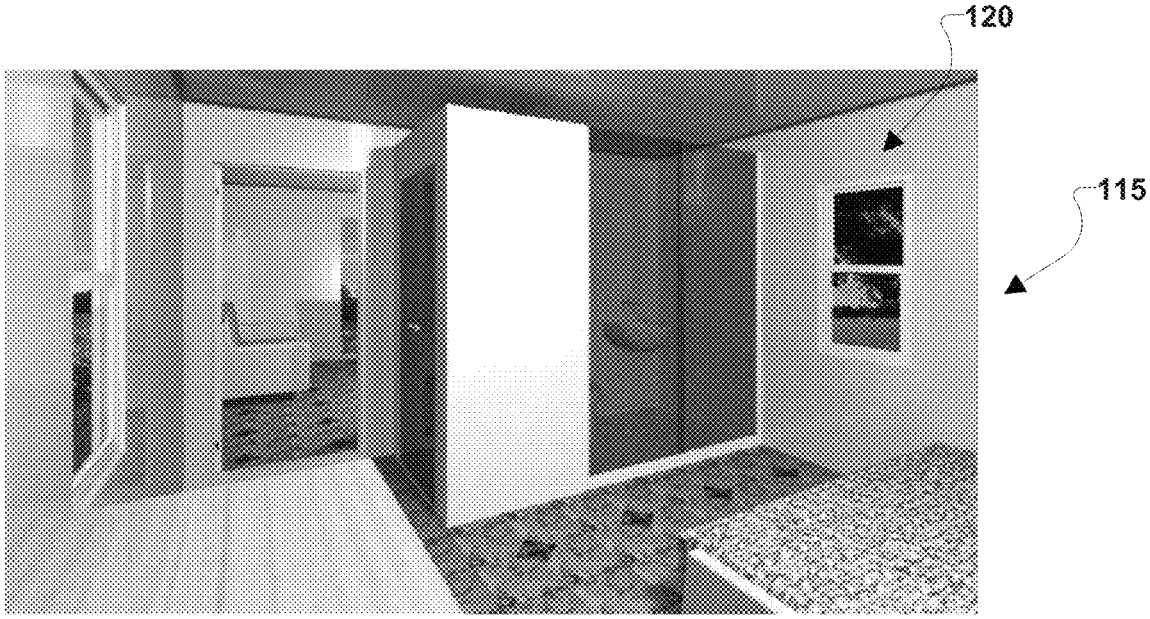
Figure 1D:
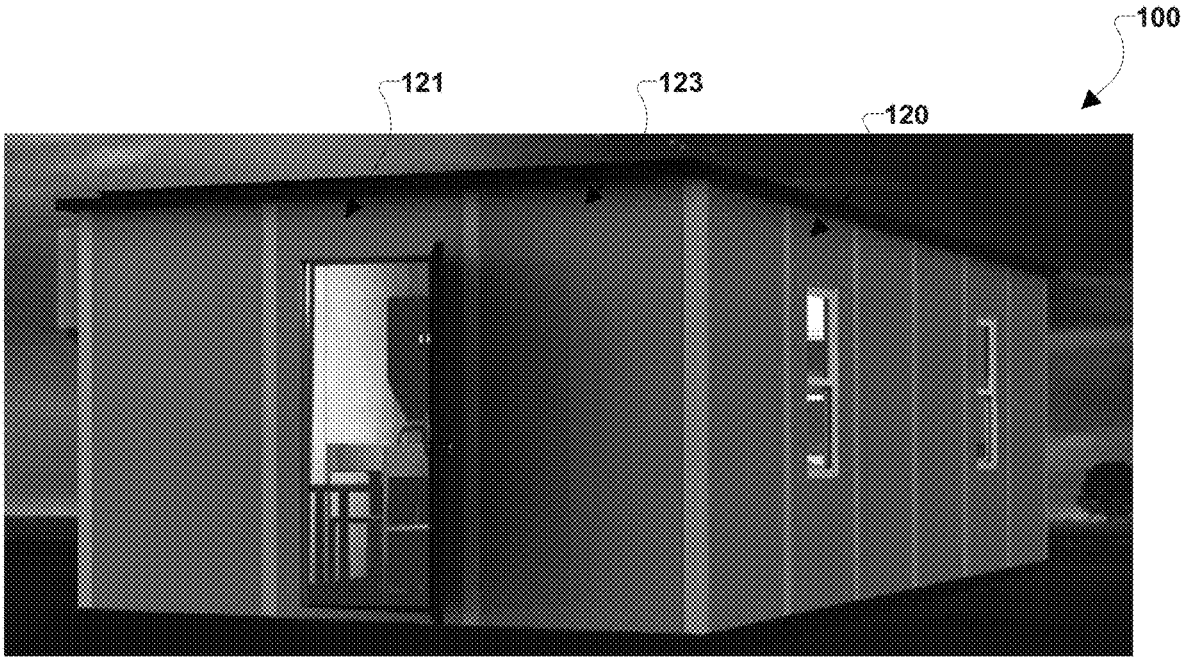
FIGS. 1D and 1E illustrate exterior views of the embodiment modular building of FIG. 1A.

FIGS. 1A-1E illustrate aspects of a modular building 100 according to various embodiments. As one example, the modular building 100 may be a modular housing unit. The modular building 100 may be any size. As one example, the modular building 100 may have a foot print of 4.1 m×8.1 m (or 13.4 ft×26.5 ft). As an example, the modular building 100 may provide a living space of 30.2 square meters (sq m) (or 325 sqft). With reference to FIGS. 1A-1E, FIG. 1A illustrates a floor plan of the modular building 100. As illustrated in FIG. 1A, the modular building 100 may include various modules therein, such as a bathroom module, bedroom module 115, and living room module 116. The bathroom module may include a toilet and sink area 103 and shower area 104. The bedroom module 115 may include a bed 101 and desk 102. The living room module 116 may include cabinets 107, a refrigerator 105, table 106, and sofa 108. The modular building may include a HVAC unit 109, such as a split AC. Exterior walls 110 may form the outer portions of the modular building 100 and interior wall 111 may separate the interior rooms of the modular building 100.

Figure 1E:
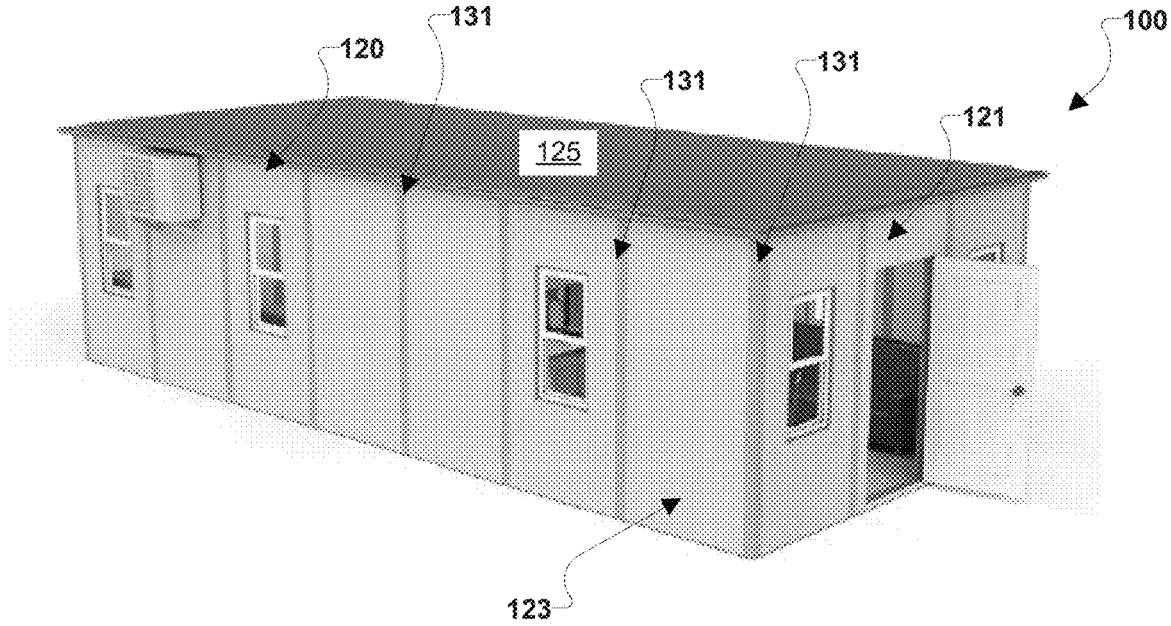

FIGS. 1B and 1C illustrate interior views from the living room module 116 and bedroom module 115, respectively, of the embodiment module building 100. FIGS. 1D and 1E illustrate exterior views of the modular building 100. As illustrated in FIGS. 1B-1E, the walls of the modular building 100 may be formed from a series of panels, such as wall panels 123, window panels 120, and door panels 121, interconnected by vertical elements 131. The interconnected panels and vertical elements 131 may support a roof 125 of the modular building 100.

Figure 2A:
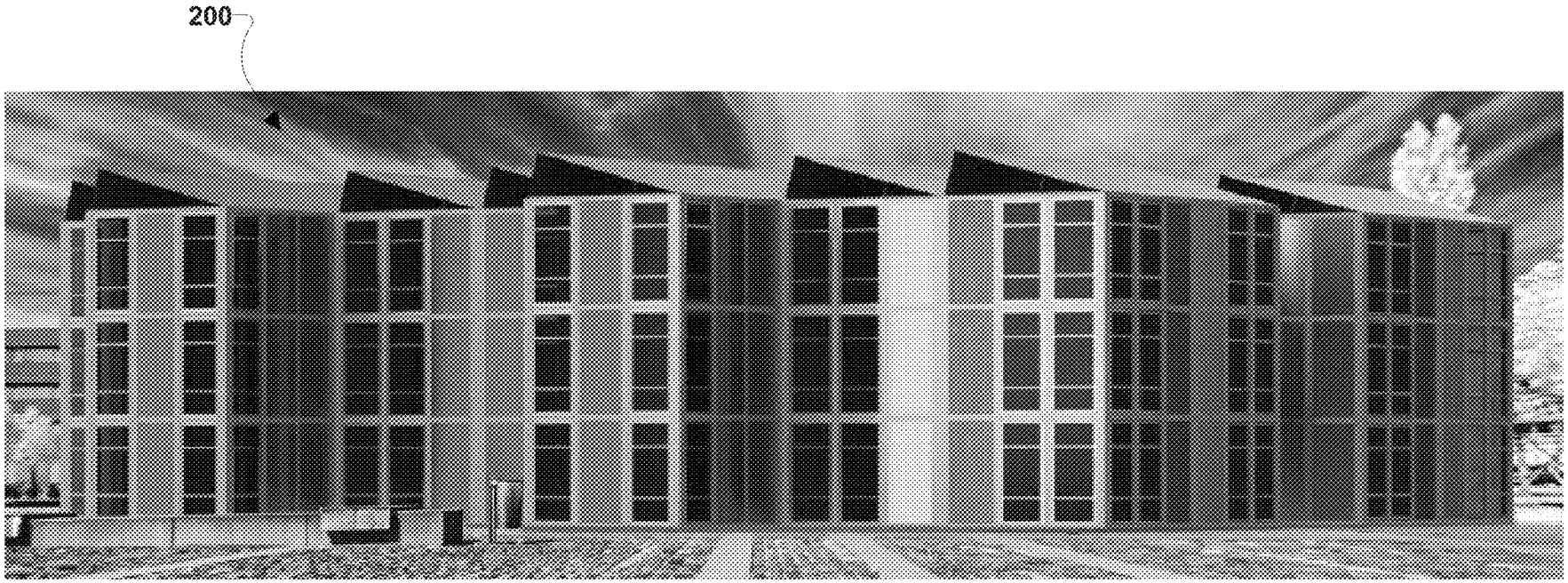
FIG. 2A is an exterior view of a multi-floor modular building according to various embodiments.
Figure 2B:
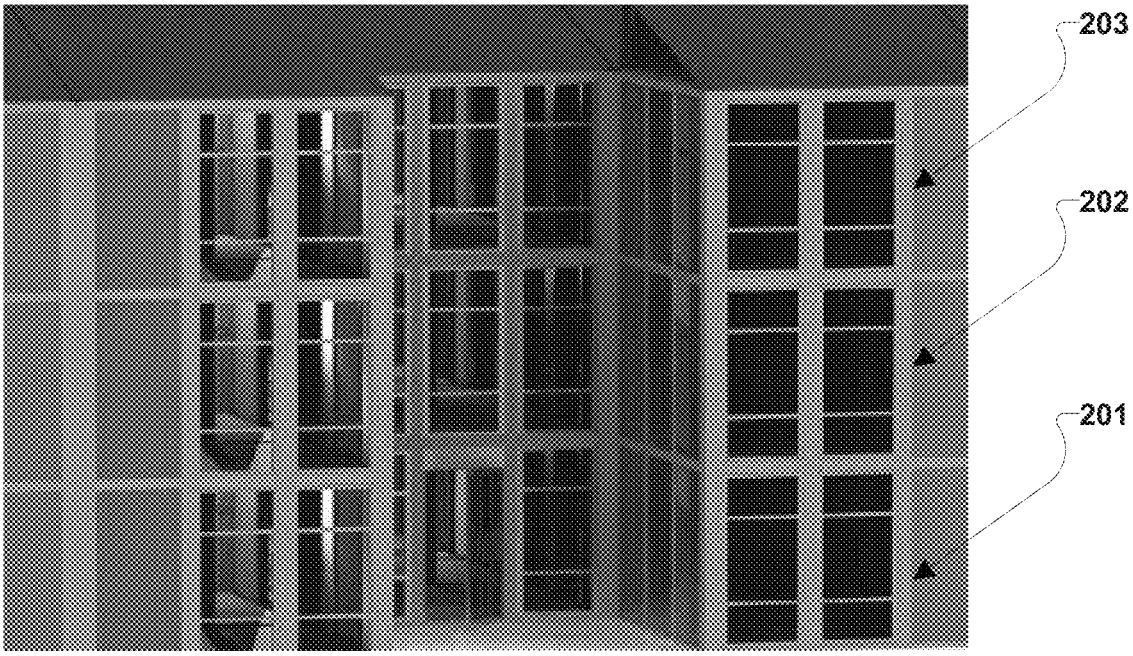
FIG. 2B is a close-up view of a portion of the embodiment multi-floor modular building of FIG. 2A.

FIG. 2A is an exterior view of a multi-floor modular building 200 according to various embodiments. FIG. 2B is a close-up view of a portion of the multi-floor modular building 200. With reference to FIGS. 1A-2B, in various embodiments, modular building units, such as modular building units similar to modular building 100, may be stacked to form the multi-floor modular building 200, such as a modular apartment building. For example, three floors 201, 202, and 203 of modular building units may be stacked on top of one another to form the multi-floor modular building 200. In such multi-floor configurations, floor panels may replace the roof panels in all but the upper most floor 203 of the modular housing units to thereby provide a floor for each successive stacked modular housing unit. As a specific example, the multi-floor modular building 200 may include ten modular housing units on a first floor 201, with ten additional modular housing units on a second floor 202, and ten additional modular housing units on third floor 203, thereby creating a three level and thirty unit multi-floor modular building 200.

Figure 3:
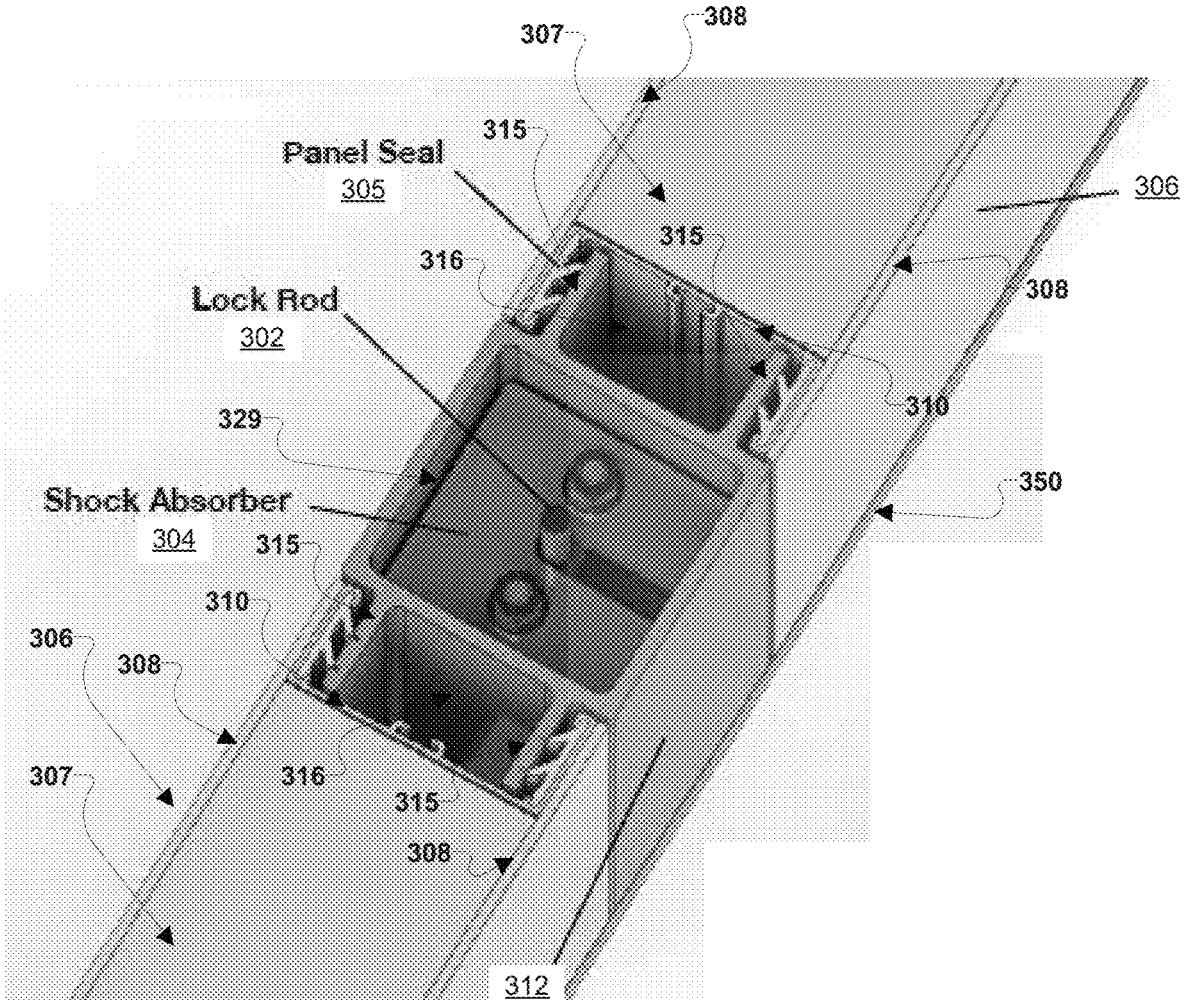
FIG. 3 is a cut-away view of a straight wall connection between two wall panels and a vertical element according to various embodiments.

FIG. 3 is a cut-away view of a straight wall connection between two wall panels 306 which correspond to wall panels 123 in FIGS. 1A-1E and a vertical element 312 which corresponds to the vertical element 131 in FIGS. 1A-1E according to various embodiments. With reference to FIGS. 1A-3, in various embodiments, the vertical element 312 may be formed from FRP. In various embodiments, the FRP may be colored and/or textured. In various embodiments, the FRP may be a thermal insulator. In various embodiments, the vertical element 312 may be an extruded and/or pultruded element formed so as to have a hollow central portion 329. However other suitable structural materials may be used. In various embodiments, the vertical element 312 may create the height for each level of a modular building. In various embodiments, vertical elements may have different profile shapes depending on the type of joint needed to connect two vertical panels (e.g., door panels, window panels, wall panels, etc.). As illustrated in FIG. 3, the vertical element 312 may be a straight wall element configured to form a straight wall connection between two panels, such as two wall panels 306 (and/or window and/or door panels). In various embodiments, the vertical element 312 may slide on to a raised portion of the lower horizontal element 350 that may be affixed to a foundation or floor.

In various embodiments, the wall panels 306 may be formed from a foam 307 core sandwiched between an aluminum frame of aluminum composite panels (ACPs) 308 and an aluminum profile frame 310. In various embodiments, the wall panels 306 may be structural insulated panels (SIPs) formed from a sandwich of ACP or other hard materials and foam. The ACP panels 308 may be a layered composite of aluminum sheeting layers adhered to the front and back of a sheet of polyethylene. The structural foam 307 (e.g., polyurethane foam, etc.) may act as an insulator (e.g., an R-38 rated insulator) and a sound absorber. However other suitable structural materials may be used. The aluminum profile frame 310 may encircle the panel 306 and support panel seals 305. The panel seal 305 may be a plastic, rubber, or other type material seal that may act as a weather seal for the joints of the modular building. In this manner, glue and/or caulk may not be needed for the joints of the modular building. The ACP panels may extend beyond the foam 307 core and form a groove structure along the edge of the wall panels 306 that supports the aluminum profile frame 310 and panel seals 305 therein. In some embodiments, the aluminum profile frame 310 may clamp the panel seals 305 in place, and the aluminum profile frame 310 and panel seals 305 may also form a groove structure within the groove structure along the edge of the wall panels 306. The groove structure formed by the aluminum profile frame 310 and panel seals 305 along the edge of the wall panels 306 may slide over a raised portion of the lower horizontal element 350 that may be affixed to a foundation or floor.

In various embodiments, the vertical element 312 may have raised features 315 on sides that interconnect with the panels, such as the two wall panels 306 (e.g., door panels, window panels, wall panels, etc.). The raised features 315 may form a tongue structure that inserts into the groove structure formed by the aluminum profile frame 310 and panel seals 305 along the edge of the wall panels 306, thereby joining the vertical element 312 with wall panels 306 by respective tongue and groove type joints. The aluminum profile frame 310 may be curved metal that holds the panel seal 305 in place. In various embodiments, the front of the panel seal 305 may have flexible wipers that contact the raised features 315 to seal the aluminum profile frame 310 to the raised features 315. When the vertical element 312 and the wall panel 306 are joined together, a channel 316, such as a vertical channel, may be formed between the vertical element 312 and the wall panel 306. The channel 316 may provide a passageway for electric, data, plumbing, HVAC (heating, ventilation, and air conditioning), and any other type connections and/or utilities suitable for use in a modular building.

In various embodiments, the vertical element 312 may be inserted over a shock absorber 304 affixed to the lower horizontal element 350. The shock absorber 304 may fit within the hollow central portion 329. A shock absorber 304 may be optional, and not all vertical elements may include a shock absorber 304. A lock rod 302 may run through the hollow central portion 329 of the vertical element 312. The lock rod 302 and/or shock absorber 304, may be components of a locking system pulling upper horizontal elements toward the lower horizontal elements and securing the vertical element 312 and wall panels 306 in place. The lock rod 302 (or lock cable, or other locking mechanism) may be tensioned during installation to create force holding the modular building walls together.

Figure 4A:
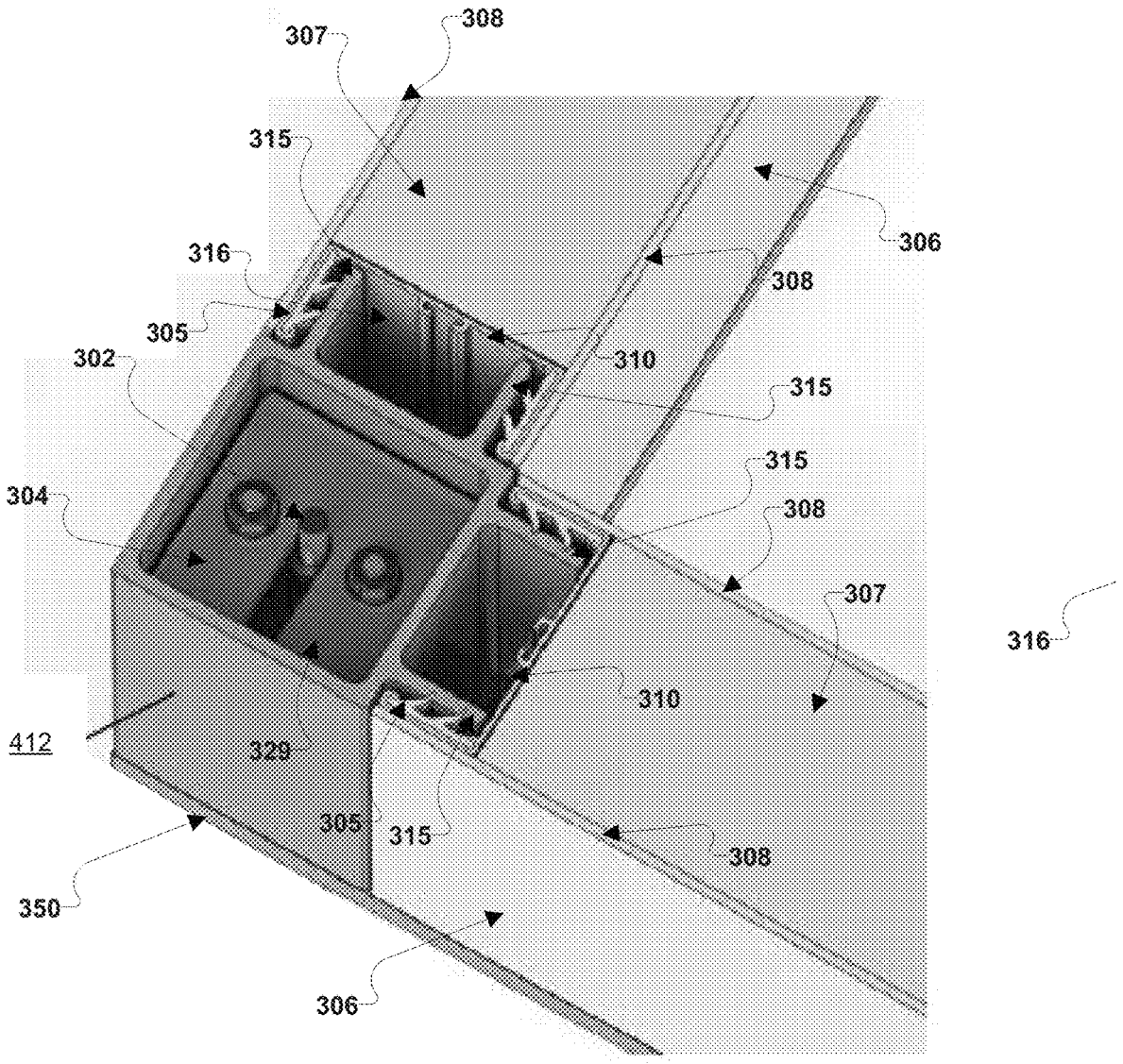
FIG. 4A is a cut-away view of a corner wall connection between two wall panels and a vertical element according to various embodiments.

FIG. 4A is a cut-away view of a corner wall connection between two wall panels 306 and a vertical element 412 according to various embodiments. With reference to FIGS. 1A-4A, the corner wall connection illustrated in FIG. 4A is similar to the straight wall connection of FIG. 3, except that the vertical elements 412 and 312 differ. Vertical element 412 may be similar to vertical element 312, except that vertical element 412 may have a different shape to form a right angle corner between two panels, such as wall panels 306. Specifically, the raised features 315 on sides that interconnect with the panels, such as the two wall panels 306, rather than being on opposite sides, may be on ninety-degree offset sides of the vertical element 312.

Figure 4B:
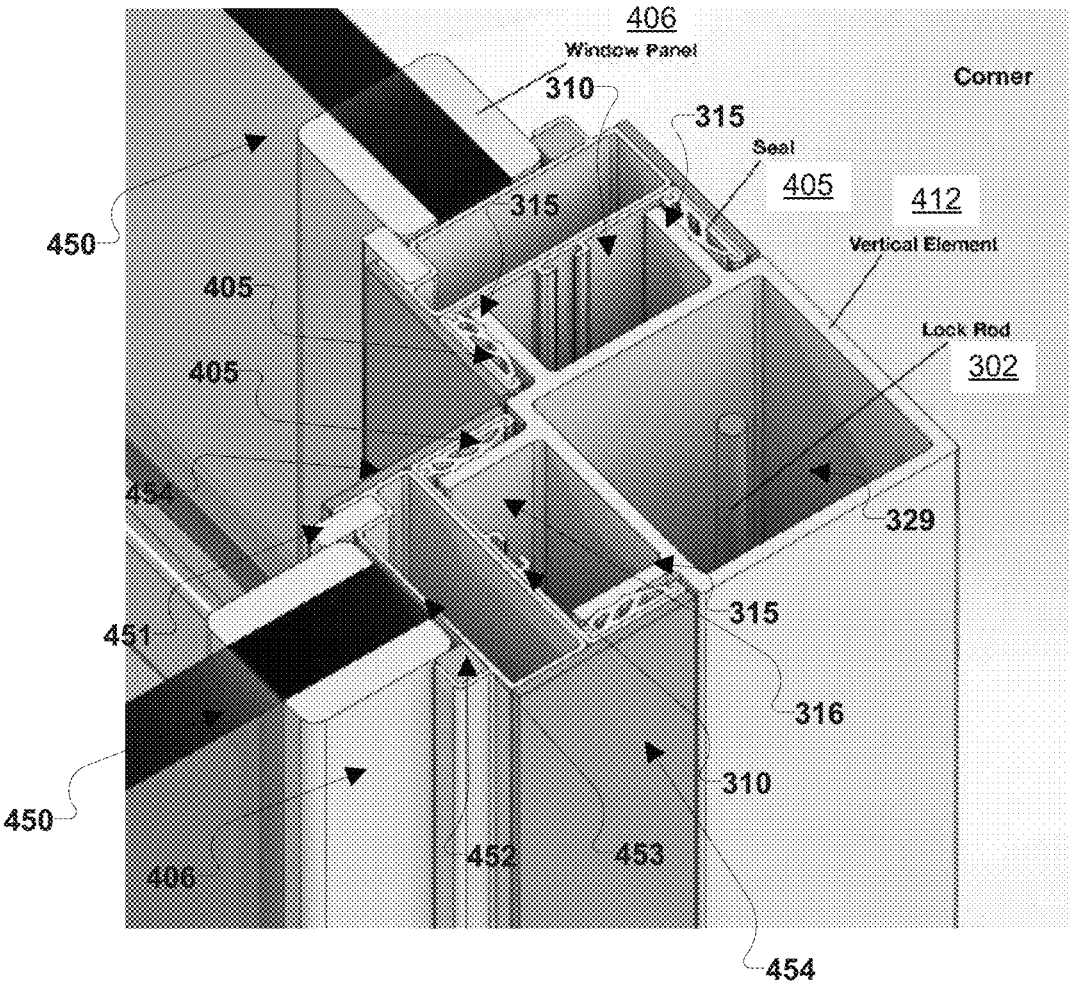
FIG. 4B is a cut-away view of a corner wall connection between two window panels and a vertical element according to various embodiments.

FIG. 4B is a cut-away view of a corner wall connection between two window panels 406 (which correspond to window panel 120 in FIGS. 1A-1E) and a vertical element 412. With reference to FIGS. 1A-4B, FIG. 4B illustrates an upper portion of the vertical element 412. The corner wall connection of FIG. 4B is similar to the corner wall connection of FIG. 4A, except rather than two wall panels 306, two window panels 406 are connected by the vertical element 412. Additionally, the panel seal 405 in FIG. 4B is configured in an alternative shape from the panel seal 305 of FIGS. 3 and 4A.

The window panels 406 may include a window pane 450 affixed to a window frame profile 453 by a spacer 452 and lock bar 451. In some embodiments, the window frame profile 453 may be formed from aluminum. In some embodiments, the spacer 452 may be formed from rubber. The window panels 406 may include panels 454 sandwiching the window frame profile 453 therebetween. Similarly to the wall panels 306, the window panels 406 may include an aluminum profile frame 310 encircling the window panel 406 and supporting the panel seals 405. The panel seal 405 may be a plastic, rubber, or other type material seal that may act as a weather seal for the joints of the modular building. The panels 454 may extend beyond the window frame profile 453 and form a groove structure along the edge of the window panels 406 that supports the aluminum profile frame 310 and panel seals 405 therein. In some embodiments, the aluminum profile frame 310 may clamp the panel seals 405 in place between raised elements 315 and aluminum profile frame 310, and the aluminum profile frame 310 and panel seals 405 may also form a groove structure within the groove structure along the edge of the window panels 406. The groove structure formed by the aluminum profile frame 310 and panel seals 405 along the edge of the window panels 406 may slide over a raised portion of the lower horizontal element 350 that may be affixed to a foundation or floor. The raised features 315 of the vertical element 412 may interconnect with the panels 306, 406. The raised features 315 may form a tongue structure that inserts into the groove structure formed by the aluminum profile frame 310 and panel seals 405 along the edge of the panels 306, 406, thereby joining the vertical element 412 with panels 306, 406 by respective tongue and groove type joints. When the vertical element 412 and the panels 306, 406 are joined together, channels 316, such vertical channels, may be formed between the vertical element 412 and the panels 306, 406 as discussed above.

Figure 5A:
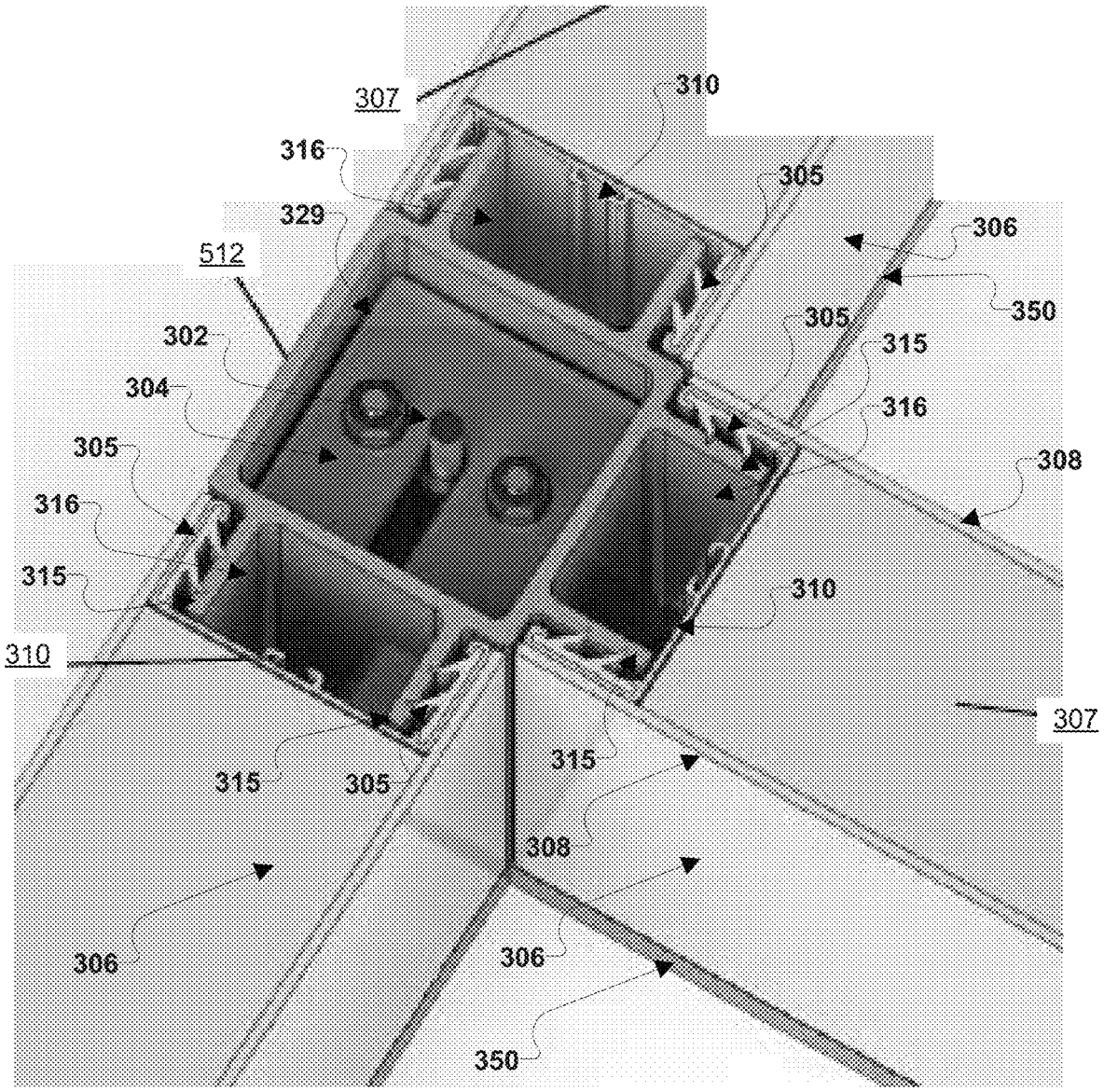
FIG. 5A is a cut-away view of a t-wall connection between three wall panels and a vertical element according to various embodiments.

FIG. 5A is a cut-away view of a t-wall connection between three wall panels and a vertical element according to various embodiments. With reference to FIGS. 1A-5A, the t-wall connection illustrated in FIG. 5A is similar to the straight wall connection of FIG. 3 and the corner wall connections of FIGS. 4A and 4B, except that the vertical elements 512, 312, and 412 differ. Vertical element 512 may be similar to vertical elements 312, 412, except that vertical element 512 may have a different shape to form a three joint (i.e., t-shaped) corner between three panels, such as wall panels 306. Specifically, the raised features 315 on sides that interconnect with the panels, such as the three wall panels 306, offset ninety degrees from one another.

Figure 5B:
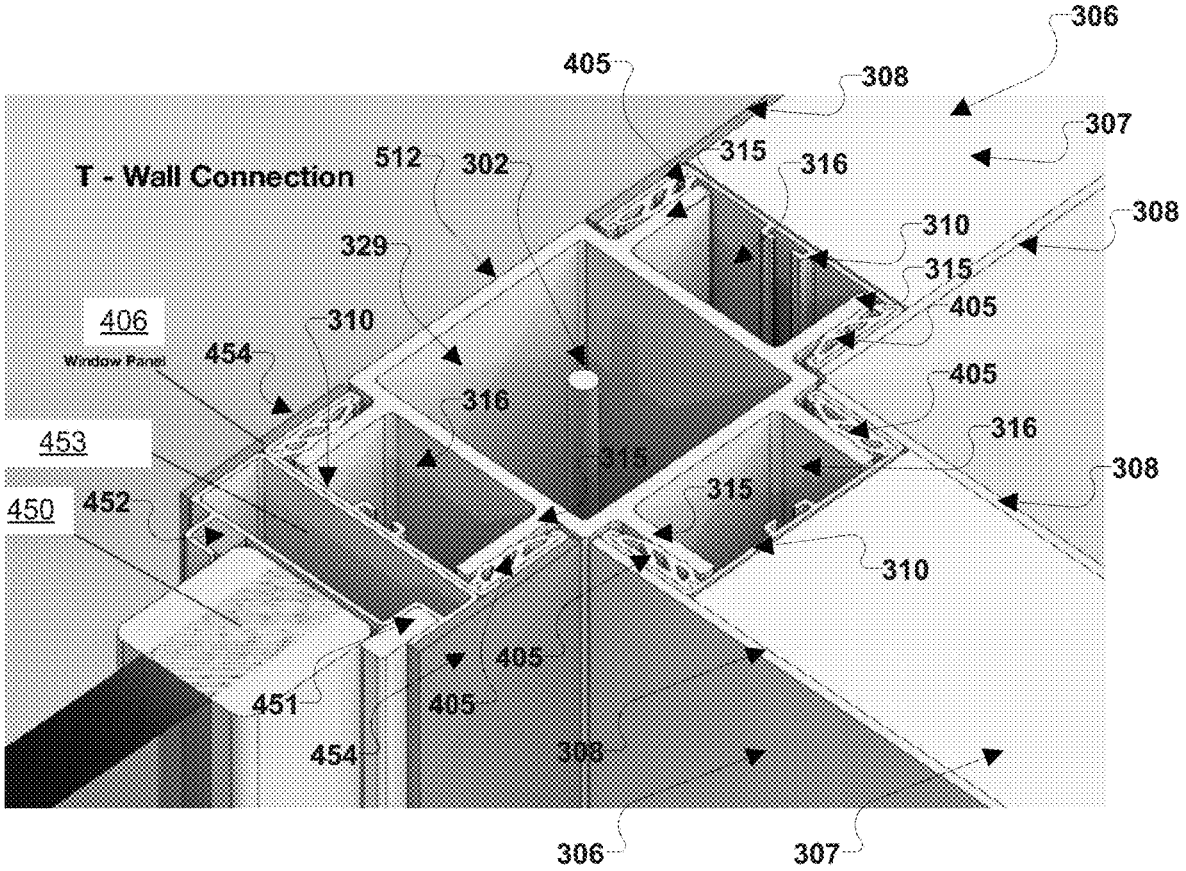
FIG. 5B is a cut-away view of a t-wall connection between two wall panels, a window panel, and a vertical element according to various embodiments.

FIG. 5B is a cut-away view of a t-wall connection between two wall panels 306, a window panel 406, and a vertical element 512. With reference to FIGS. 1A-5B, the t-wall connection illustrated in FIG. 5A is similar to the t-wall connection in FIG. 5A, except the connection is made with panel seals 405 rather than panel seals 305.

Figure 6A:
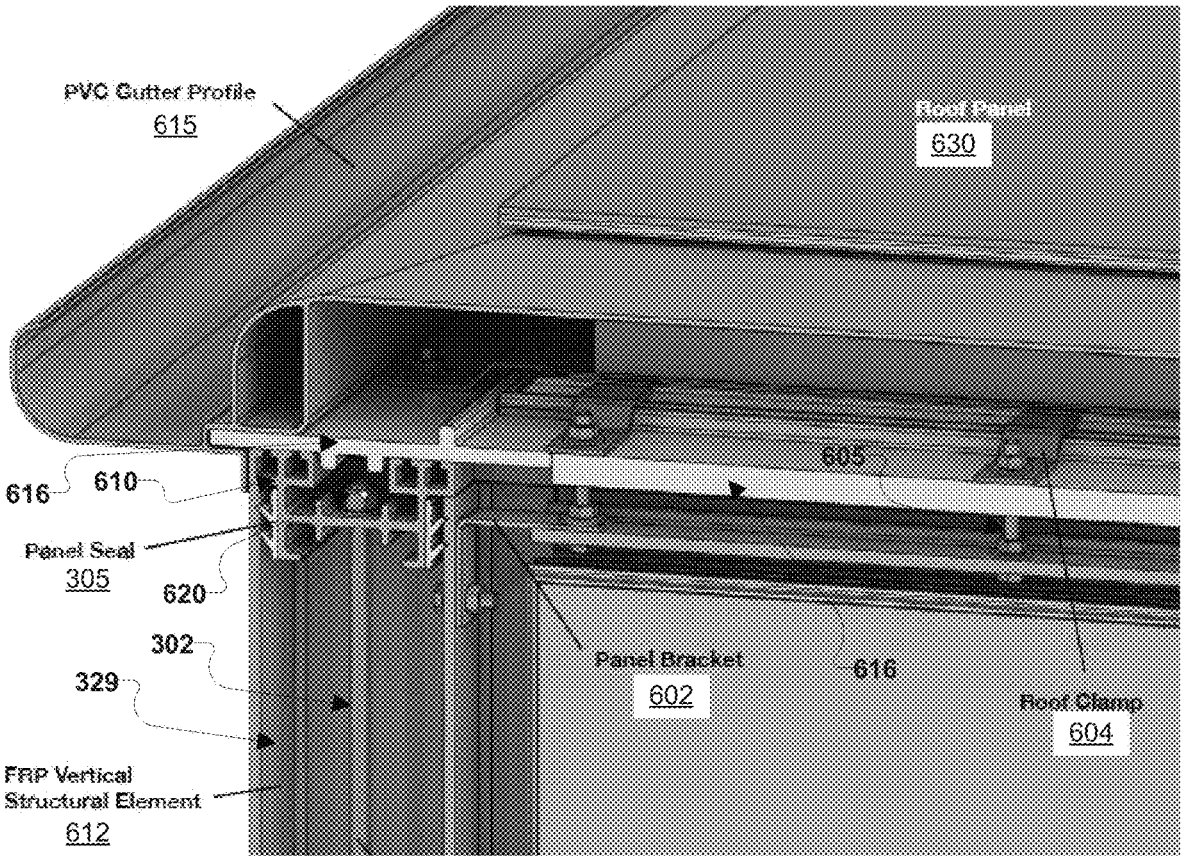
FIG. 6A is a cut-away view of a roof portion, vertical element, and wall panel of a modular building according to various embodiments.
Figure 6B:
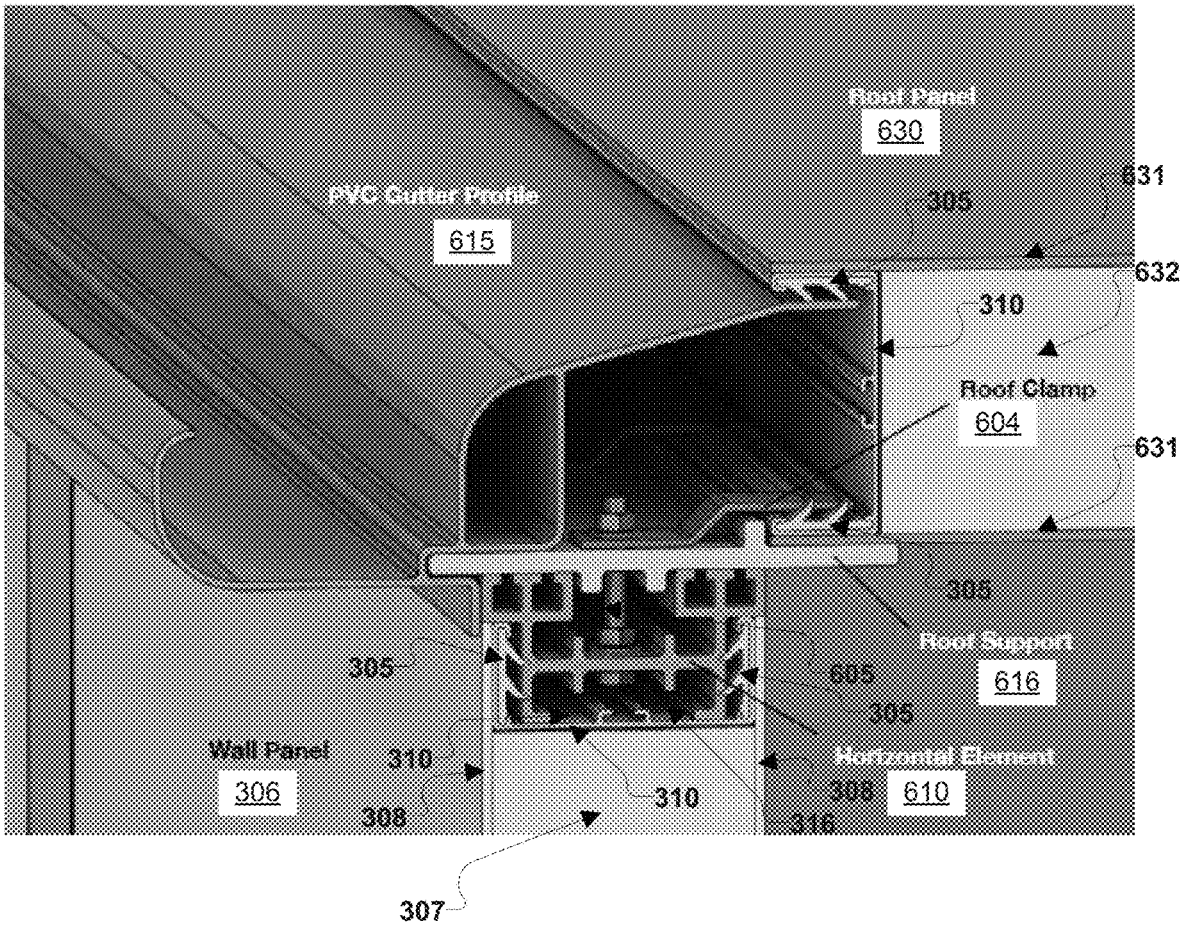
FIG. 6B is another cut-away view of the embodiment modular building of FIG. 6A.

FIGS. 6A and 6B are cut-away views of a roof portion, vertical element 612, and wall panel of an embodiments modular building. With reference to FIGS. 1A-6B, the vertical element 612 may be any type vertical element, such as a straight wall vertical element 312, corner vertical element 412, t-wall vertical element 512, etc. As illustrated in FIG. 6A, an upper horizontal element 610 may be inserted in the upper portion of the vertical element 612. The lock rod 302 may pass through the hollow central portion 329 of the vertical element 612 and be affixed to the upper horizontal element 610, such as by a nut 620. The lock rod 302 may be tensioned to pull the upper horizontal element 610 down onto the vertical element 612 and the vertical element 612 down onto a horizontal element 350 under the vertical element 612. The upper horizontal element 610 may include panel seals 305 on a portion of the upper horizontal element 610 that insert into the hollow central portion 329 of the vertical element 612. Similarly, the upper horizontal element 610 may insert into the groove portion of the wall panel 306 formed by the aluminum profile frame 310 and panel seals 305 along the edge of the wall panels 306. As illustrated in FIG. 6B, the when the wall panel 306 is joined with the upper horizontal element 610, a channel 316 may be formed therebetween.

A roof support 616 may be configured to affix to the upper horizontal element 610. The roof support 616 may be a set of elongated bars or hollow frame. The roof support 616 may extend horizontally beyond the upper horizontal elements 610 to support a roof panel 630. In various embodiments, roof clamps 604 may affix the roof panels 630 and roof trusses 902 (see FIGS. 9A and 9B) to the roof support 616 and thereby to the external vertical walls of the modular building formed by the joined vertical elements 612 and the wall panels 306. In various embodiments, the roof panels 630 may be formed from a foam 632 core sandwiched between an aluminum frame of aluminum composite panels (ACPs) 631 and an aluminum profile frame 310. In various embodiments, the roof panels 630 may be structural insulated panels (SIPs) formed from a sandwich of ACP or other hard materials and foam. The ACPs 631 may be a layered composite of aluminum sheeting layers adhered to the front and back of a sheet of polyethylene. The structural foam 632 (e.g., polyurethane, etc.) may act as an insulator (e.g., an R-38 rated insulator) and a sound absorber. The aluminum profile frame 310 may encircle the panel 630 and support panel seals 305. The panel seal 305 may be a plastic, rubber, or other type material seal that may act as a weather seal for the joints of the modular building. The ACP panels 630 may extend beyond the foam 632 core and form a groove structure along the edge of the roof panel 630 that supports the aluminum profile frame 310 and panel seals 305 therein. In some embodiments, the aluminum profile frame 310 may clamp the panel seals 305 in place, and the aluminum profile frame 310 and panel seals 305 may also form a groove structure within the groove structure along the edge of the roof panel 630. The groove structure formed by the aluminum profile frame 310 and panel seals 305 along the edge of the roof panel 630 may be affixed to the roof support 616 by one or more roof clamps 604. In various embodiments, a weather seal for the roof section may be formed as a gutter 615 forming a channel to collect rain water. The gutter 615 may insert into a groove of the roof panel 630.

In some embodiments, a panel bracket 602 may affix a portion of a wall panel 306 to the vertical element 612. In some embodiments, a roof support fastener 605, such as a bolt, etc., may extend through the roof clamps 604, roof support, and upper horizontal elements 610 to clamp the roof panel 630 and upper horizontal element 610 to the panels of the modular building, such as the wall panels 306.

Figure 6C:
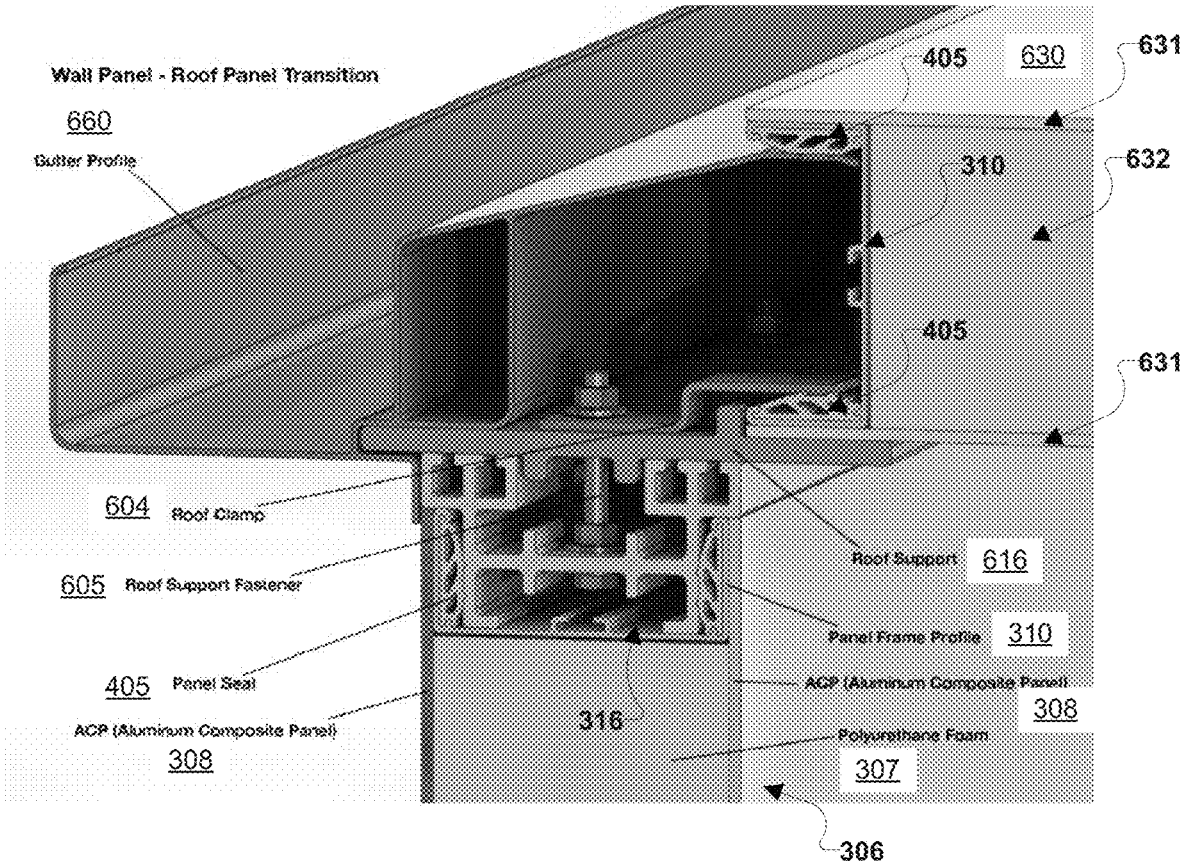
FIG. 6C is a cut-away view of a roof portion and wall panel of a modular building according to various embodiments.

FIG. 6C is a cut-away view of a roof portion and wall panel 306 of a modular building according to various embodiments. With reference to FIGS. 1A-6C, the roof portion of FIG. 6C is similar to the roof portion of FIGS. 6A and 6B, except a different gutter 660 shape and different panel seal 405 shape is shown.

Figure 7A:
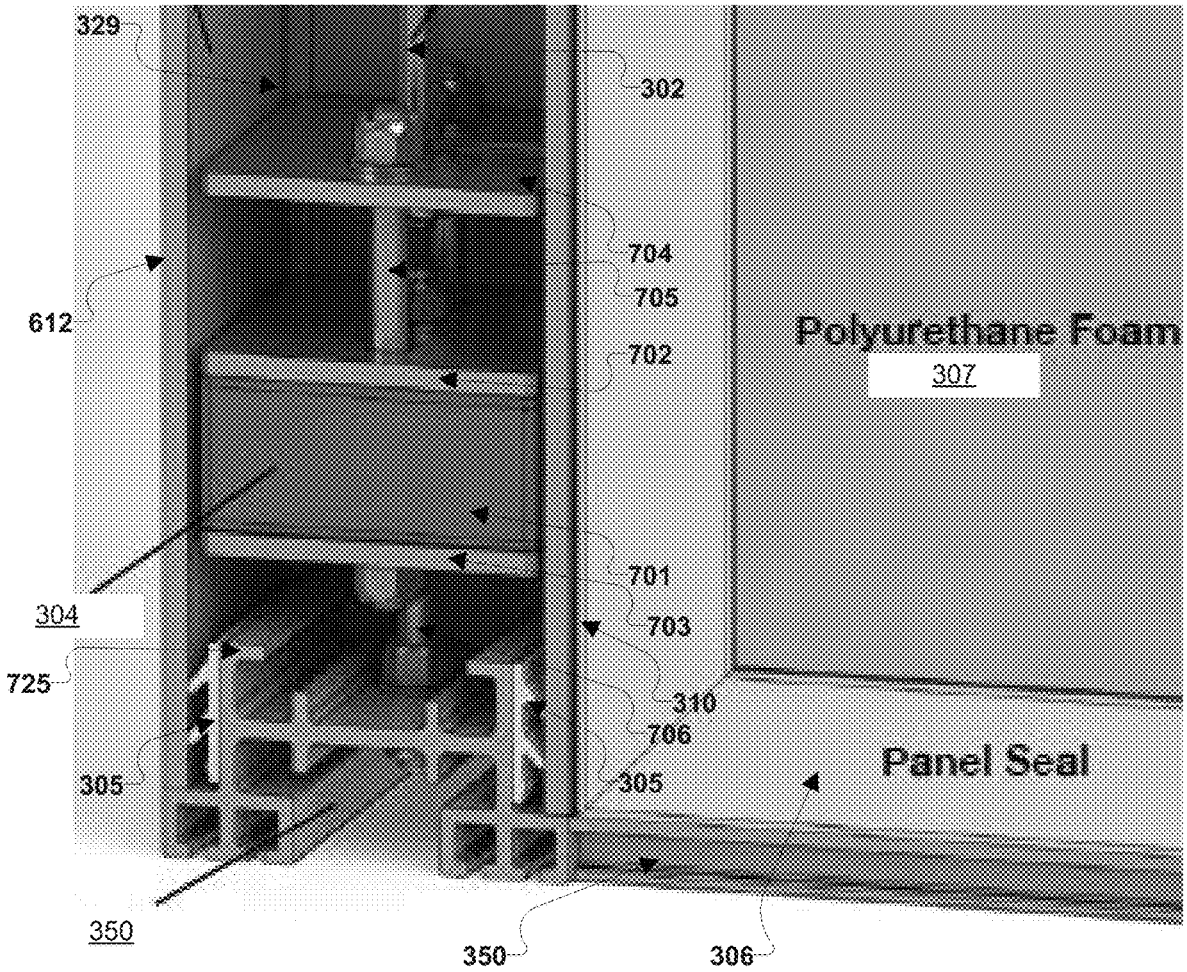
FIG. 7A is a cut-away view of a lower horizontal element, vertical element, and wall panel of a modular building according to various embodiments.

FIG. 7A is a cut-away view of a lower horizontal element 350, vertical element 612, and wall panel 306 connected together. With reference to FIGS. 1A-7A, the vertical element 612 may be any type vertical element, such as a straight wall vertical element 312, corner vertical element 412, t-wall vertical element 512, etc. FIG. 7A illustrates one type of shock absorber 304 suitable for use with the various embodiments. In the shock absorber 304 may be formed from a rubber block 701 supported between a top plate 702 and bottom plate 703. In other embodiments, the rubber block 701 may be replace with a hydraulic system (e.g., a hydraulic cylinder, etc.), spring, or other type shock absorber. The top plate 702 may be compressed against the rubber block 701 by a fastener 706, such as a bolt, etc., that passes through the top plate 702, rubber block 701, and bottom plate 703. The fastener 706 may affix the shock absorber 304 to a lower horizontal element 350. The bottom plate 703 may be compressed against the rubber block 701 by one or more fasteners 705 (e.g., one or more bolts, etc.), such as two fasteners 705, etc., that passes through the bottom plate 703, rubber block 701, and top bottom plate 702. The one or more fasteners 705 may connect to a catch plate 704 that is affixed to the lock rod 302. The catch plate 704 may be affixed to the lock rod 302 in any manner. For example, the lock rod 302 may slide into a slot in the catch plate 704. The rubber block 701 may expand and contract between the upper plate 702 and lower plate 703 to dampen forces acting on the vertical element 612. In various embodiments, the shock absorber 304 may be incorporated into the locking system to increase stress resistance during heavy wind loads, explosions, and/or earthquakes. In various embodiments, the shock absorber 304 of the locking system may enable the roof to move and snap back during a negative pressure spike. The tension of the lock rod 302 and shock absorber 304 may pull the upper horizontal elements 610 down toward the lower horizontal elements 350 to secure the walls of the modular building. As seen in FIG. 7A, the lower horizontal element 350 may include panel seals 305 on the rail feature 725 of the lower horizontal element 350 contacting the inner surface of the vertical element 612 when inserted into the hollow central portion 329 of the vertical element 612.

Figure 7B:
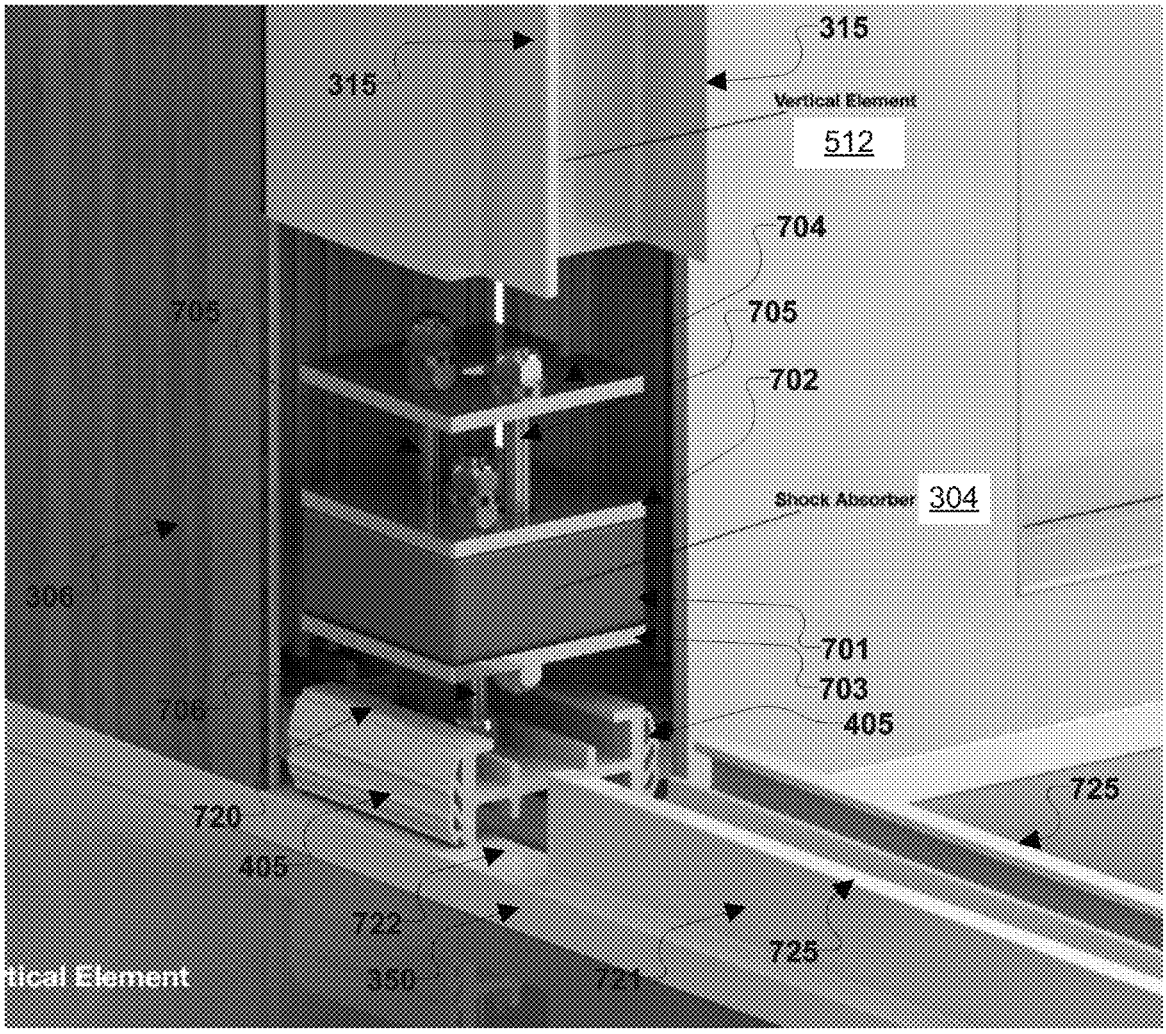
FIG. 7B is a component diagram of a lower horizontal element, vertical element, and wall panel being slid together to form a modular building according to various embodiments.

FIG. 7B is a component diagram of a lower horizontal element 350, vertical element 512, and wall panel 306 being slid together. With reference to FIGS. 1A-7B, the lower horizontal element 350 may include a first raised portion 720 and a second raised portion 721. The first raised portion 720 and the second raised portion 721 may both include rail features 725. The first raised portion 720 may be separated from the second raised portion 721 so as to form a slot 722 therebetween. The slot 722 may receive the raised elements 315 of the vertical element 512 when slid together. The vertical element 512 is shown being slid over the shock absorber 304. The first raised portion 720 of the lower horizontal element 350 may include a panel seal 405 affixed to the rail elements 725, while the second raised portion 721 may not include a panel seal on the rail elements 725.

Figure 7C:
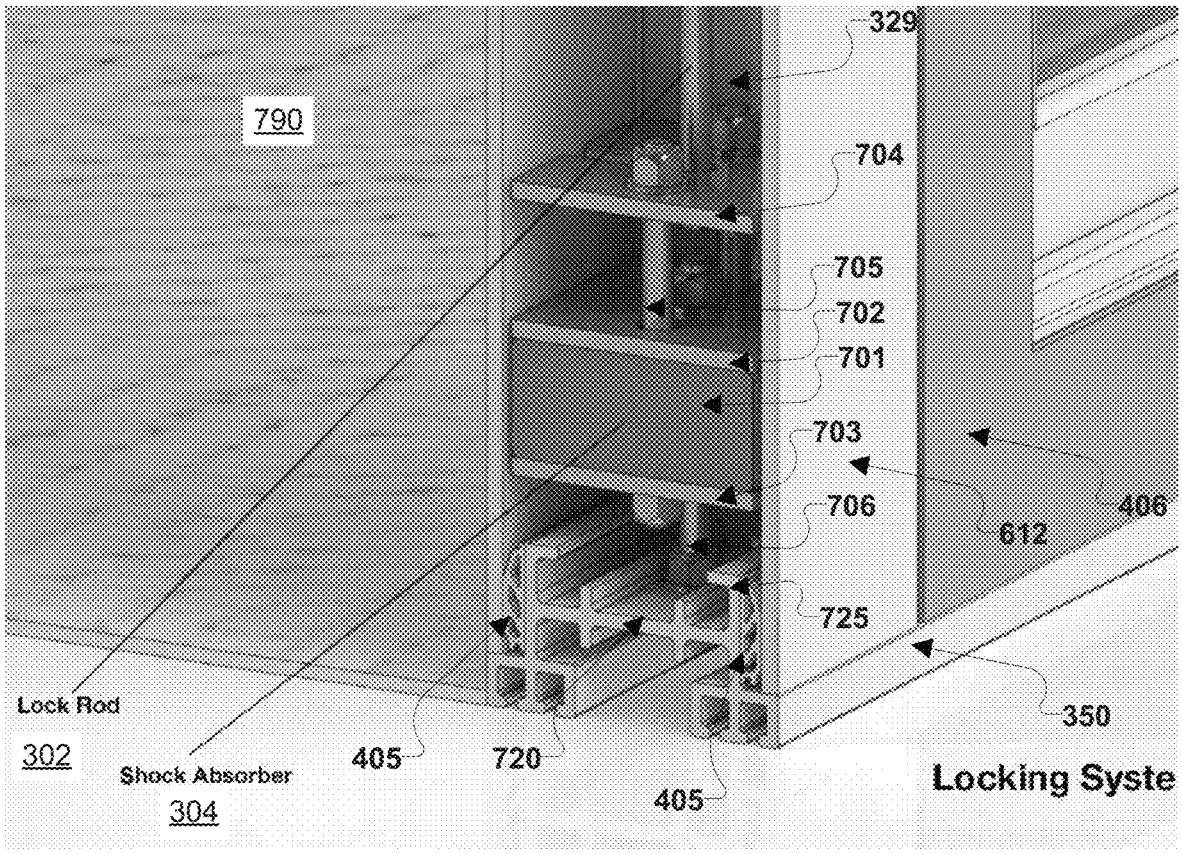
FIG. 7C is a cut-away view of a lower horizontal element and vertical element of a modular building according to various embodiments.

FIG. 7C is a cut-away view of a lower horizontal element 350 and vertical element 612 connected together with a window panel 406. With reference to FIGS. 1-7C, a floor 790 is also visible in FIG. 7C.

Figure 8:
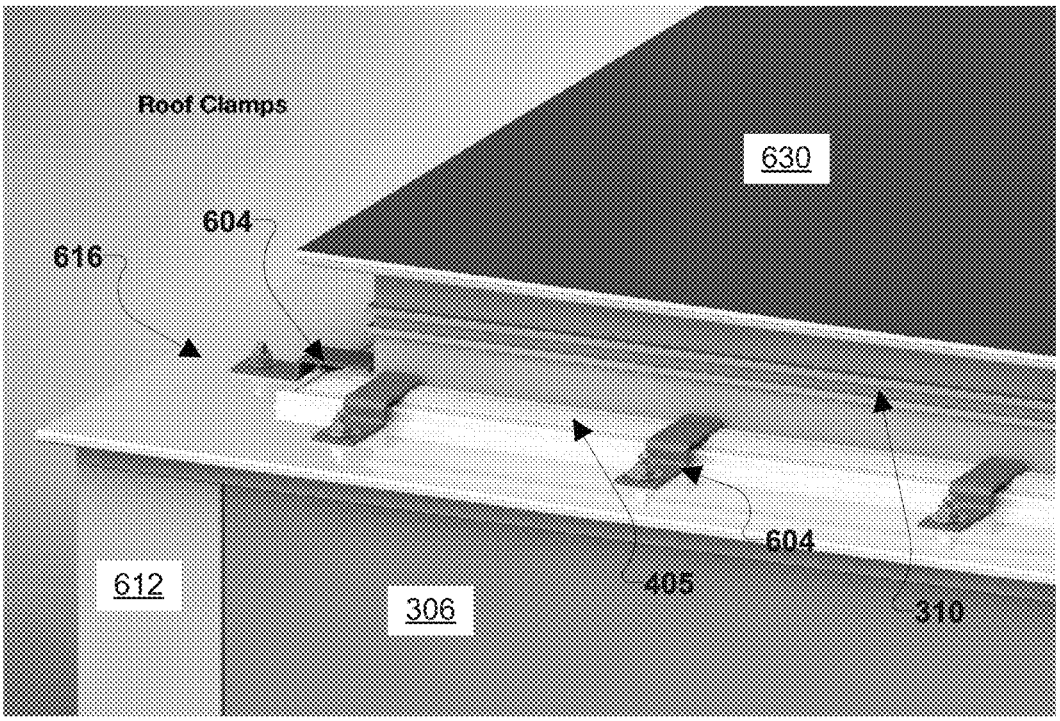
FIG. 8 is a view of a roof portion of a modular building according to various embodiments.

FIG. 8 is a view of a roof portion of a modular building. With reference to FIGS. 1A-8, the roof portion is similar to the roof portions shown in FIGS. 6A-6C, except no gutter is shown. The roof support is illustrated clamped to the wall of the building formed by the vertical element 612 and the wall panel 306 by the roof clamps 604. As illustrated in FIG. 8, the roof clamps 604 may extend over the panel seal 405 of the roof panel 630 and into the groove formed by the aluminum frame profile 310.

Figure 9A:
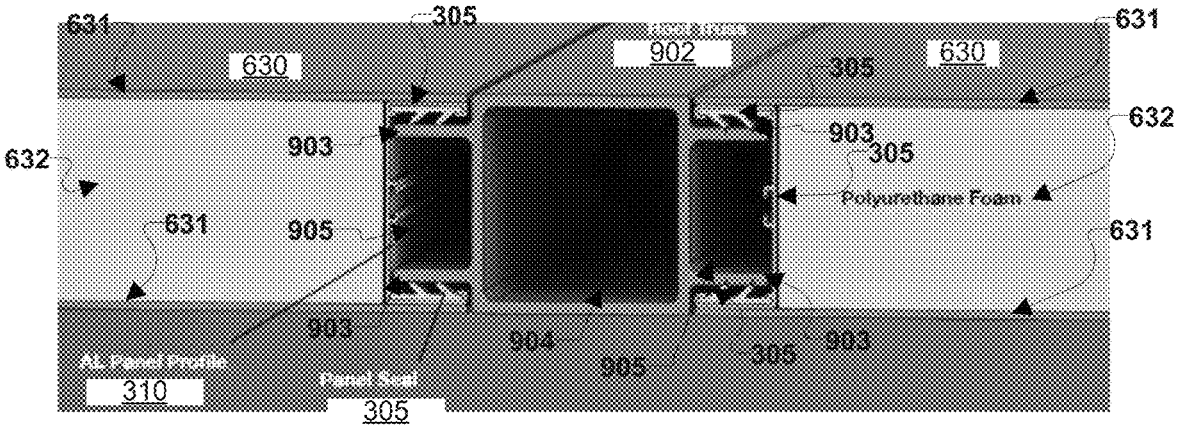
FIGS. 9A and 9B are cut-away views of roof portions of a modular building according to various embodiments.
Figure 9B:
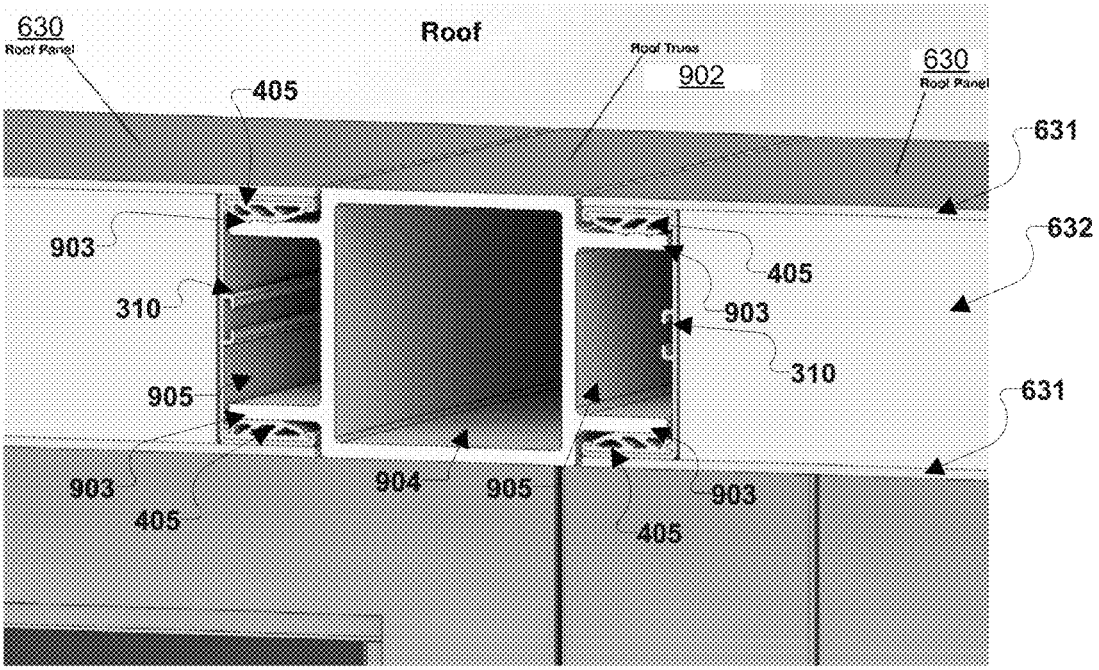

FIGS. 9A and 9B are cut-away views of roof portions of a modular building according to various embodiments. With reference to FIGS. 1A-9B, FIG. 9A shows a roof truss 902 connected between two roof panels 630 with one shape of panel seal 305 while FIG. 9B shows the roof truss 902 connected between two roof panels 630 with another shape of panel seal 405. Roof trusses 902 may be similar to vertical elements (e.g., vertical elements 412, 612, etc.) and may connect two roof panels 630 together. The roof trusses 902 may include a hollow center portion 904.

In various embodiments, the roof trusses 902 may have raised features 903 on sides that interconnect with the panels, such as the two roof panels 630. The raised features 903 may form a tongue structure that inserts into the groove structure formed by the aluminum profile frame 310 and panel seals 305, 405 along the edge of the roof panels 630, thereby joining the roof trusses 902 with roof panels 630 by respective tongue and groove type joints. When the roof trusses 902 with roof panels 630 are joined together, a channel 905, such as a horizontal channel, may be formed between the roof trusses 902 with roof panels 630. The channel 905 may provide a passageway for electric, data, plumbing, HVAC (heating, ventilation, and air conditioning), and any other type connections and/or utilities suitable for use in a modular building.

Figure 10A:
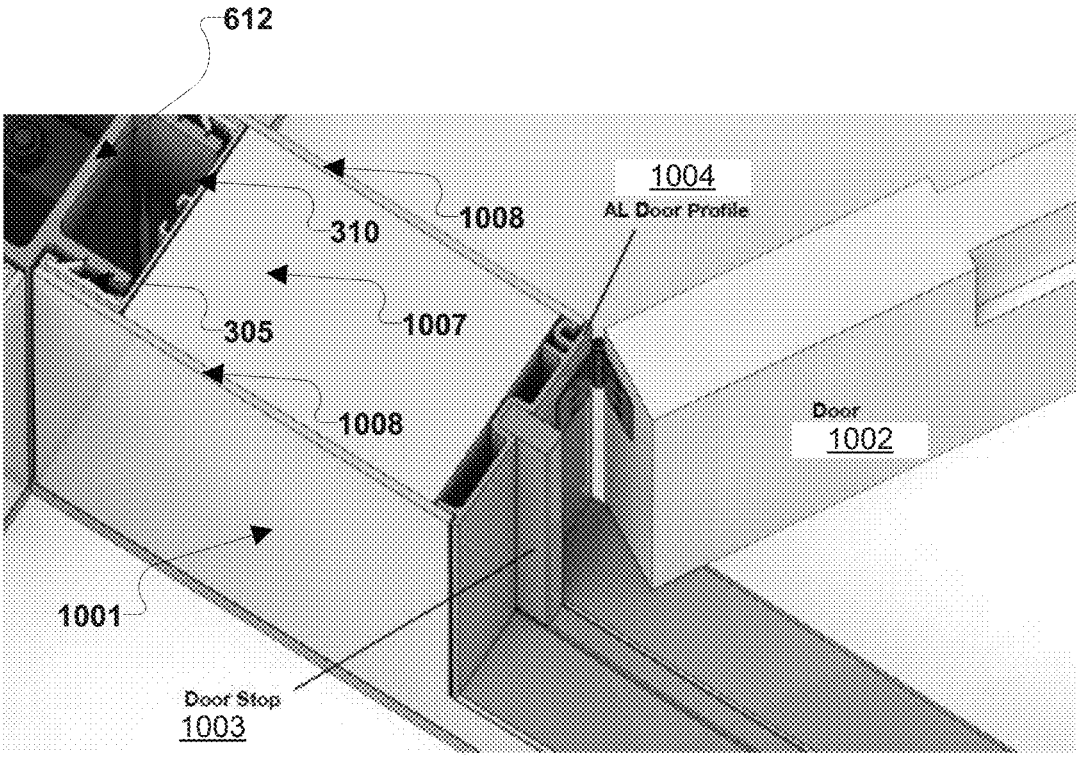
FIG. 10A is a cut-away view of a door panel of a modular building according to various embodiments.
Figure 10B:
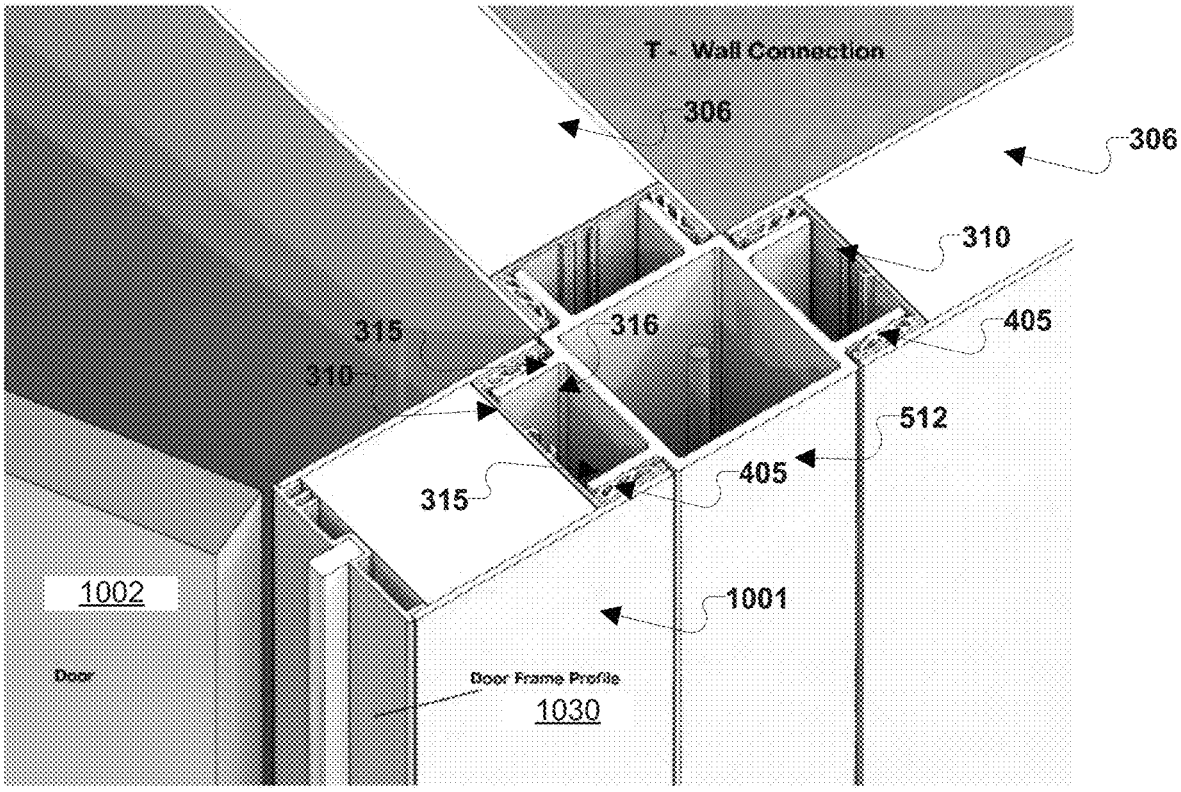
FIG. 10B is a cut-away view of another door panel of a modular building according to various embodiments.
Figure 11:
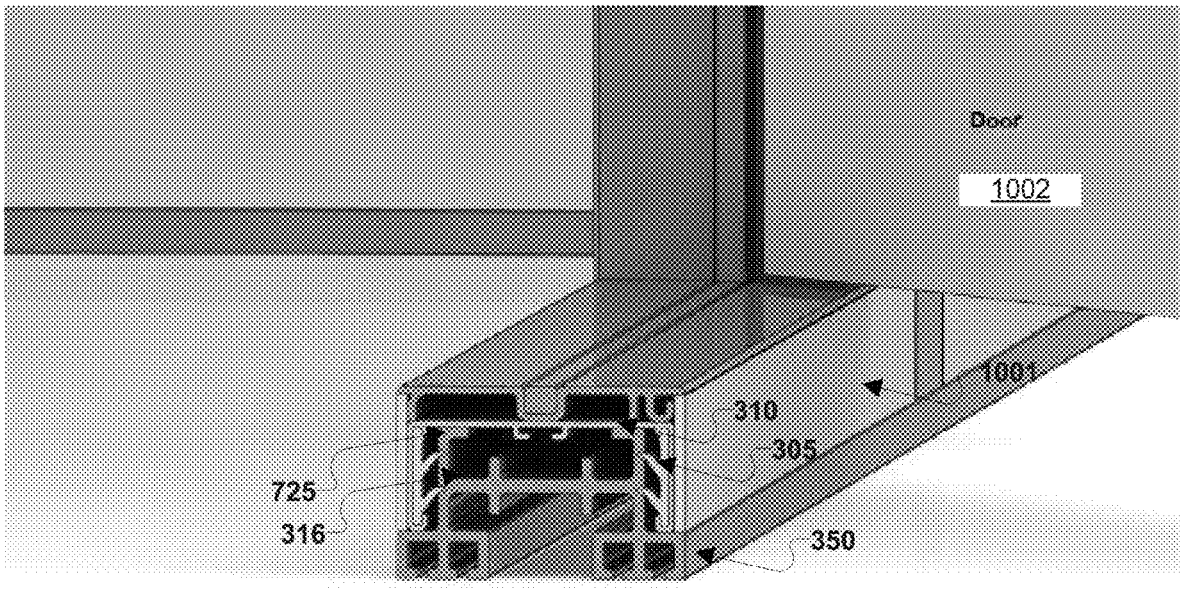
FIG. 11 is a cut-away view of a door panel of a modular building according to various embodiments.

FIGS. 10A-11 are cut away views of embodiment door panels 1001. With reference to FIGS. 1A-11, the door panel 1001 that corresponds to the door panel 121 in FIGS. 1B-1E and may include a door 1002, door stop 1003, a door frame profile 1030, aluminum composite panels (ACPs) 1008, a foam core 1007, and an aluminum profile frame 310. The ACPs 1008 may be a layered composite of aluminum sheeting layers adhered to the front and back of a sheet of polyethylene. In various embodiments, the wall panels door panel 1001 may be structural insulated panels (SIPs) formed from a sandwich of ACP or other hard materials and foam. The door may be affixed to the door frame profile 1030 by one or more hinges. The door panel 1001 may include panels 1008 sandwiching the door frame profile 1030 and foam core 1007 therebetween. Similarly to the wall panels 306 and the window panels 406, the door panels 1001 may include an aluminum profile frame 310 encircling the door panel 1001 and supporting the panel seals 305 and/or 405. The panels 1008 may extend beyond the door frame profile 1030 and foam core 1007 and form a groove structure along the edge of the door panels 1001 that supports the aluminum profile frame 310 and panel seals 305, 405 therein. In some embodiments, the aluminum profile frame 310 may clamp the panel seals 305, 405 in place, and the aluminum profile frame 310 and panel seals 305, 405 may also form a groove structure within the groove structure along the edge of the door panels 1001. The groove structure formed by the aluminum profile frame 310 and panel seals 305, 405 along the edge of the door panels 1001 may slide over a raised portion (e.g., a raised portion include the rail features 725) of the lower horizontal element 350 that may be affixed to a foundation or floor. The aluminum profile frame 310 may rest on the rail features 725 of the lower horizontal element 350 and a channel 316 may be formed between the lower horizontal element 350 and aluminum profile frame 310 between the rail features 725. The raised features 315 of the vertical element (e.g., vertical element 612, 512, etc.) may interconnect with the door panel 1001. The raised features 315 may form a tongue structure that inserts into the groove structure formed by the aluminum profile frame 310 and panel seals 305, 405 along the edge of the door panel 1001, thereby joining the vertical element with the door panel 1001 by respective tongue and groove type joints. When the vertical element and the panel 1001 are joined together, channels 316, such as vertical channels, may be formed between the vertical element and the panels 1001 as discussed above. Additionally, when the horizontal element (e.g., upper horizontal element 610 and/or lower horizontal element 350, etc.) are joined together, channels 316, such as horizontal channels, may be formed between the horizontal element and the panels 1001 as discussed above.

Figure 12:
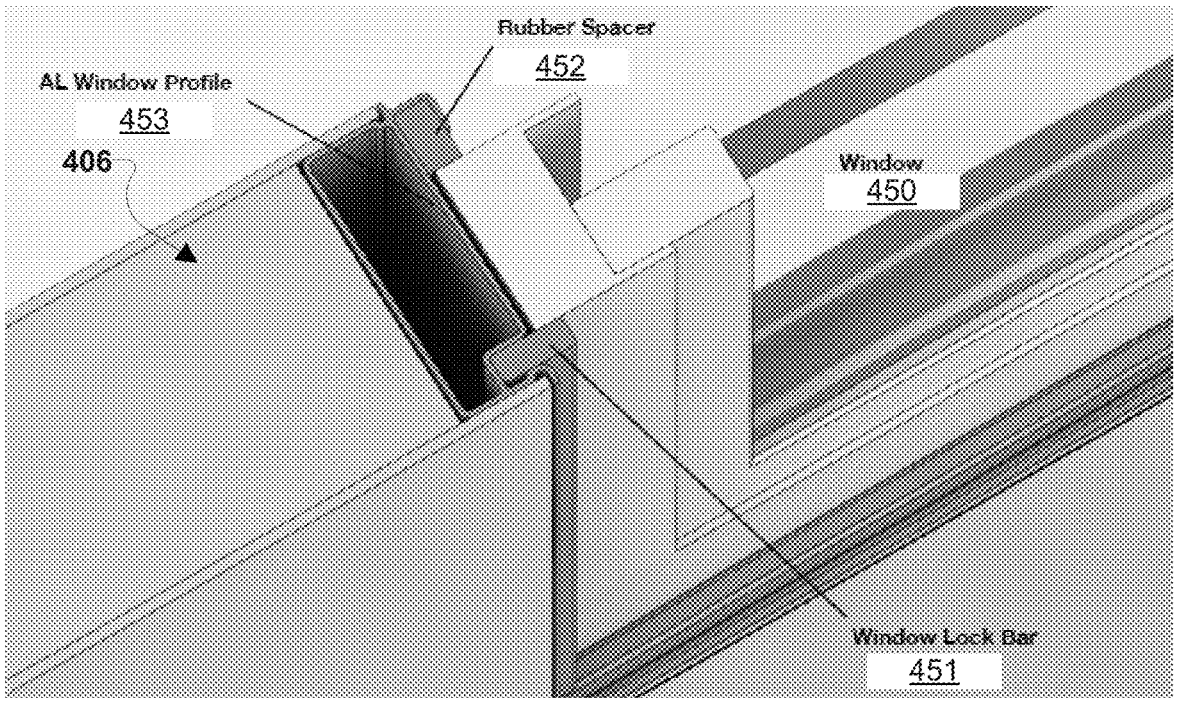
FIG. 12 is a cut-away view of a window panel of a modular building according to various embodiments.
Figure 13:
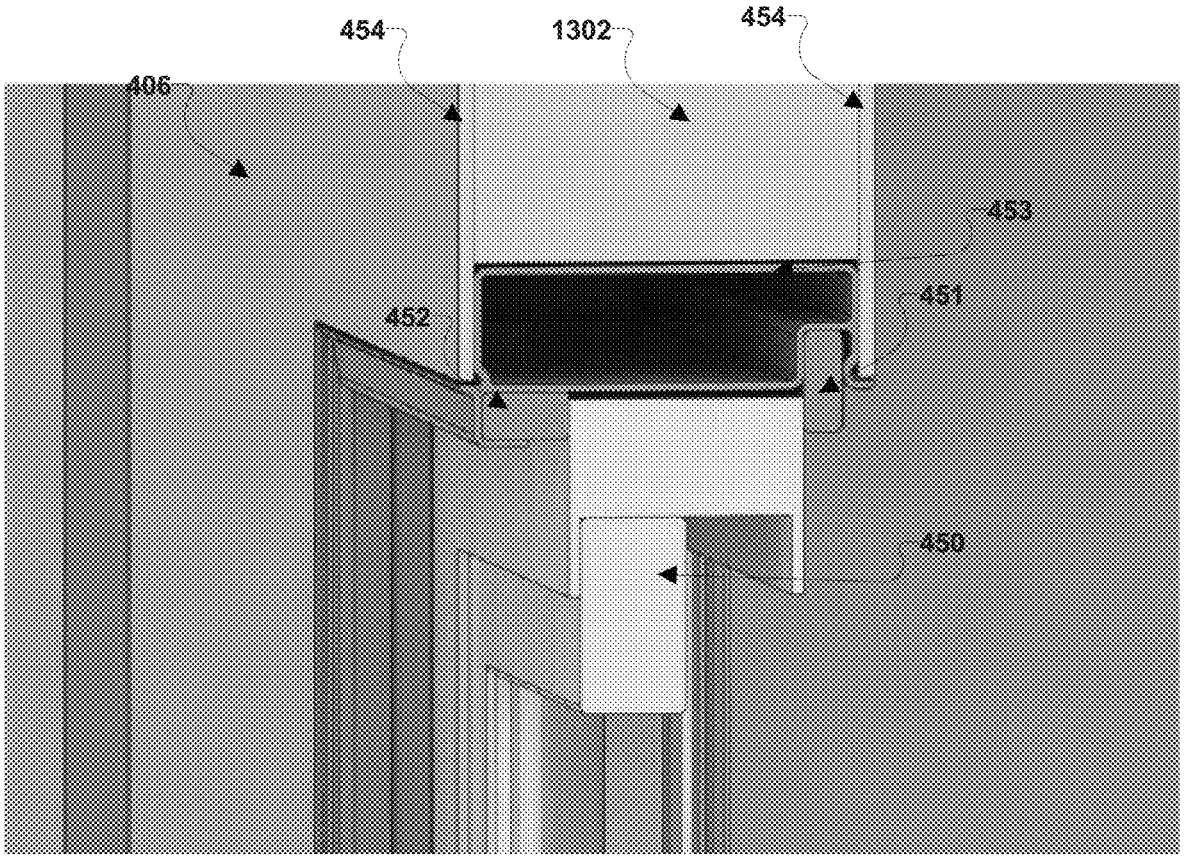
FIG. 13 is another cut-away view of the embodiment window panel of FIG. 12.

FIGS. 12 and 13 illustrate cut-away views of the embodiment window panel 406. With reference to FIGS. 1A-13, in alternative configurations, the window panel may include additional foam core 1302 between the panels 454. The dimensions of spacer 452 may also be modified to accommodate thicker or thinner window panels.

Figure 14:
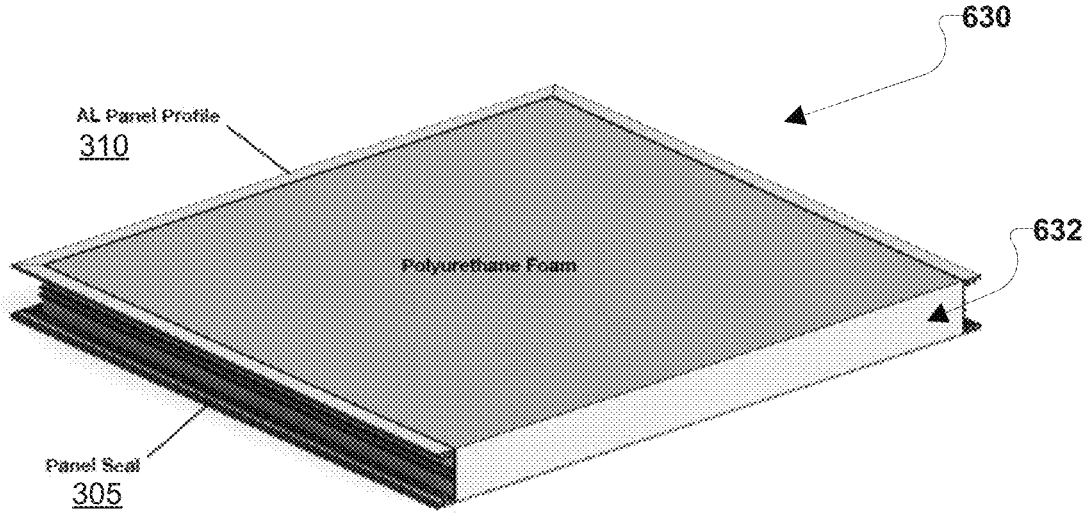
FIG. 14 is a cut-away view of a roof panel according to various embodiments with the aluminum composite panel removed.
Figure 15:
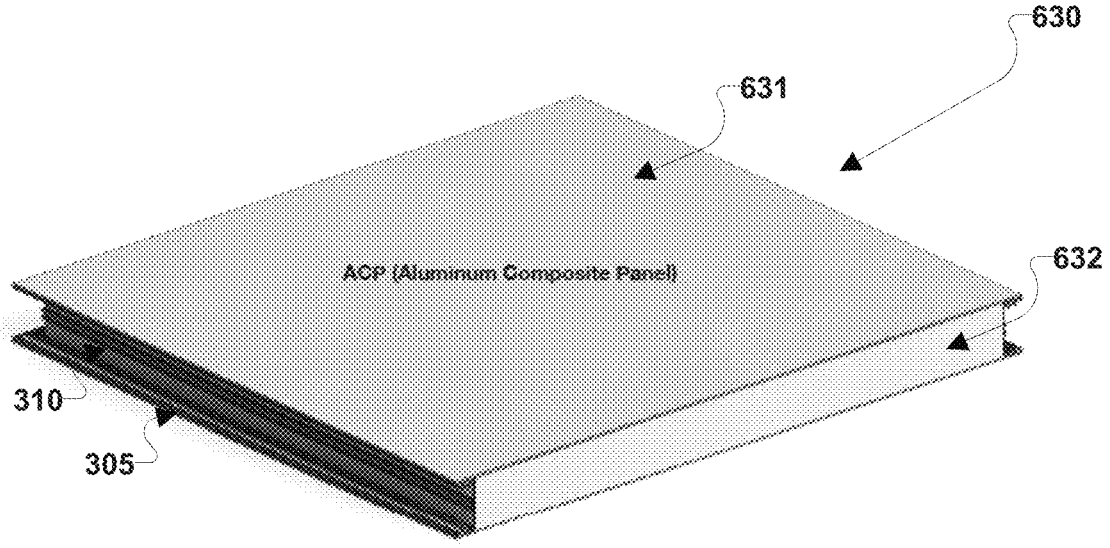
FIG. 15 is a cut-away view of a roof panel according to various embodiments.

FIGS. 14 and 15 are cut-away views of a roof panel 630 according to various embodiments. With reference to FIGS. 1A-15, FIG. 14 shows the roof panel 630 with the aluminum composite panel 631 removed, while FIG. 15 shows the roof panel 630 with the aluminum composite panel 631 installed. In FIG. 14, the aluminum profile frame 310 encircling the roof panel is visible supporting the panel seal 305.

Figure 16A:
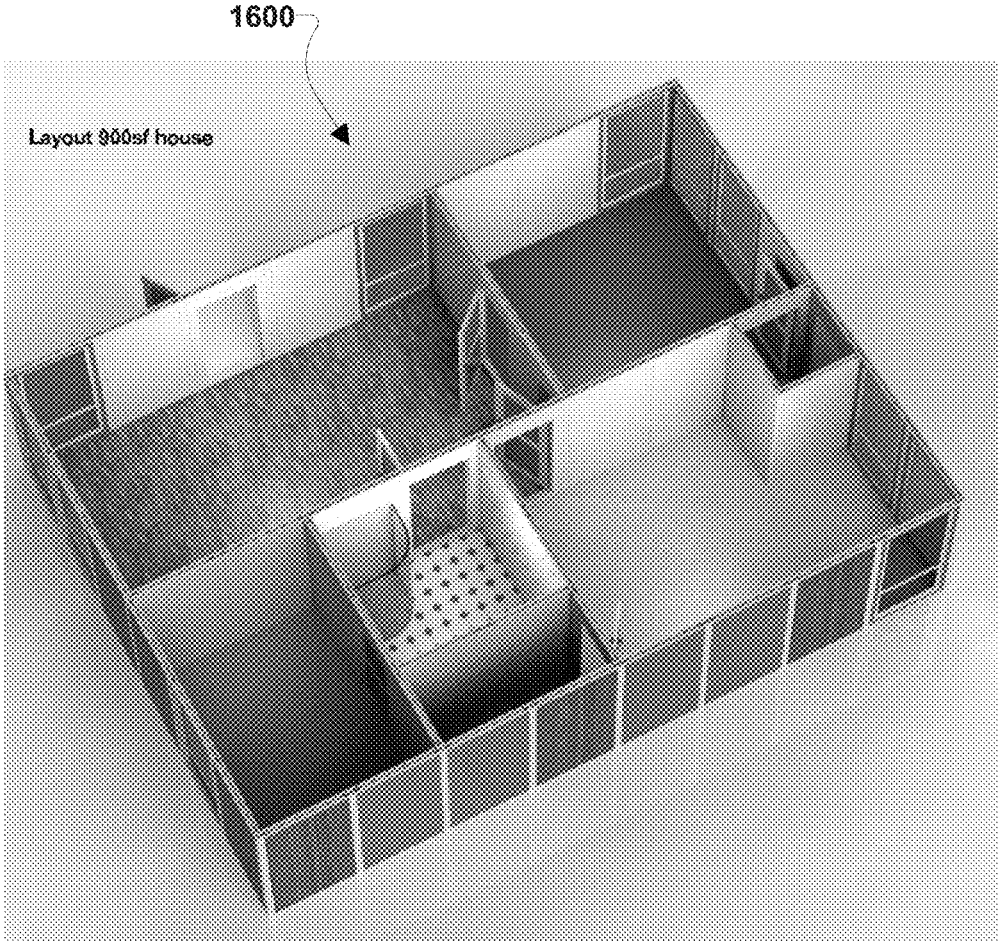
FIGS. 16A-16C illustrate views of another modular building according to various embodiments.
Figure 16B:
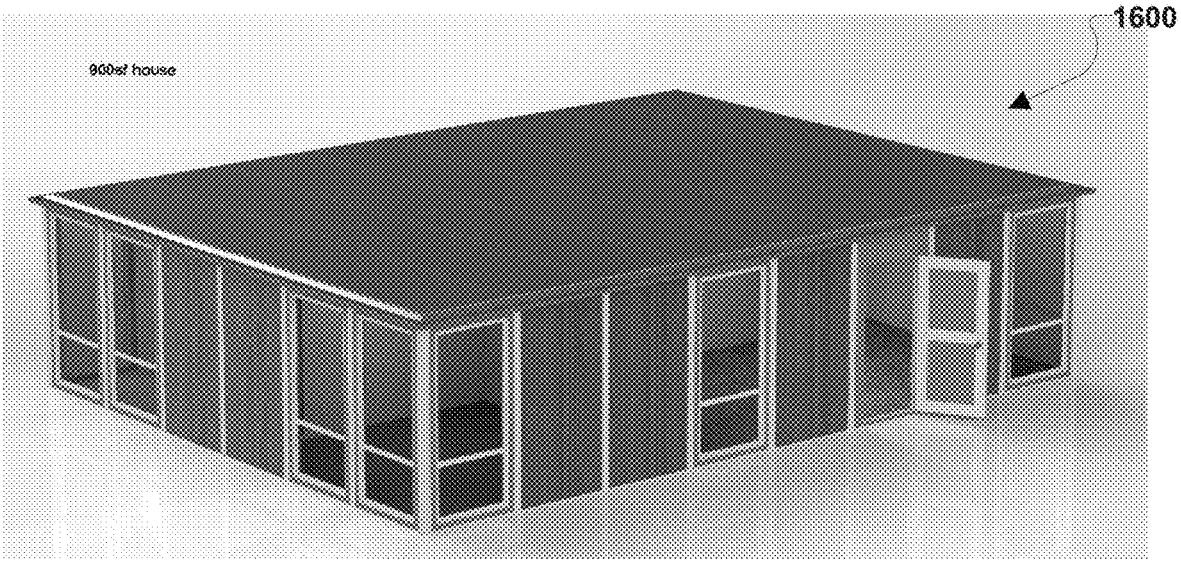
Figure 16C:
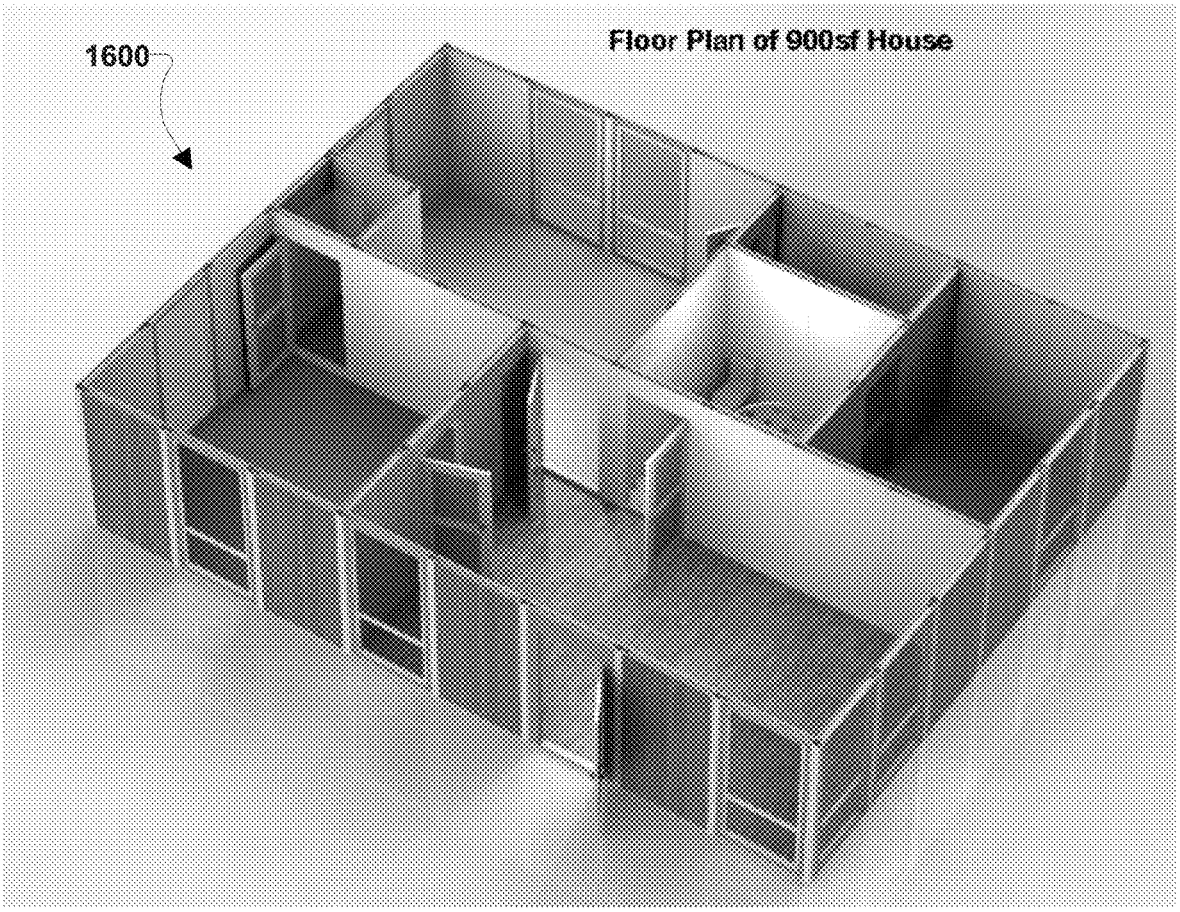

FIGS. 16A-16C illustrate views of another modular building 1600 according to various embodiments. With reference to FIGS. 1A-16C, the modular building 1600 may include more than two rooms and may be larger than the building of FIGS. 1A-1E.

Figure 17:
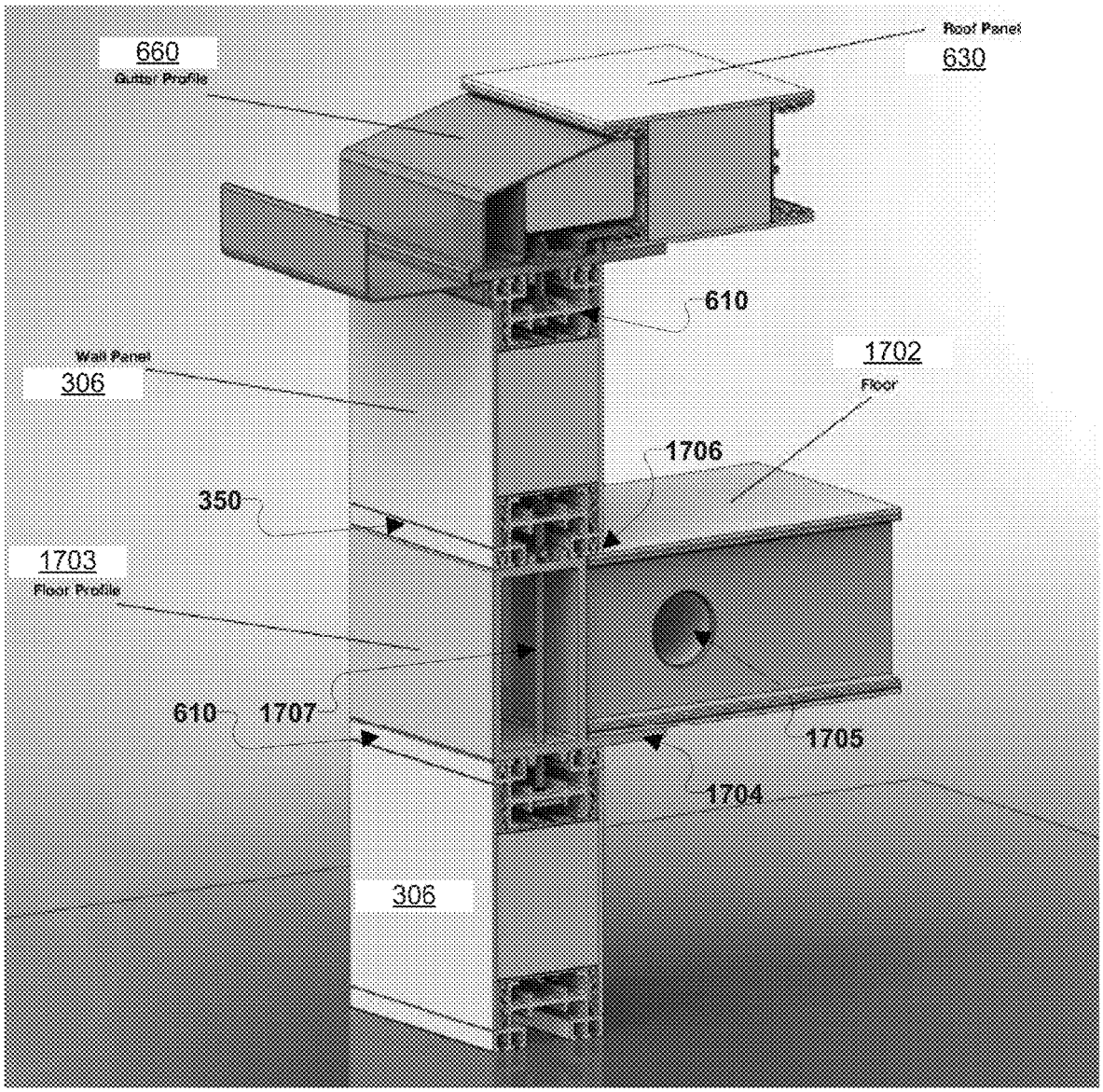
FIG. 17 is a cut-away view of a floor support for a modular building according to various embodiments.

FIG. 17 is a cut-away view of a floor support 1703 for a modular building according to various embodiments. With reference to FIGS. 1A-17, the floor support 1703 may be configured to affix to the upper horizontal elements 610. In this manner, the floor support 1703 may enable the construction of multi-floor modular buildings. The floor support 1703 may include a floor anchor 1707, such as a bolt, etc., running through a hollow center portion of the floor support 1703 and connecting to the upper horizontal portion 610 of the lower level and the lower horizontal portion 350 of the upper level. The floor support 1703 may be a horizontal element configured to support a floor section 1702 and/or lower horizontal elements 350. In various embodiments, a floor section 1702 may be similar in construction to a roof as described herein, such as formed from a series of panels and trusses. The floor section 1702 may be supported by a protrusion 1704 extending inward toward the center of the modular building from the floor support 1703. The floor portion 1702 may be include passages 1705 therein to provide a passageway for electric, data, plumbing, HVAC (heating, ventilation, and air conditioning), and any other type connections and/or utilities suitable for use in a modular building. The floor support 1703 may extend horizontally beyond the upper horizontal elements 610 on which it is affixed to support the floor 1702. The lower horizontal elements 350 of the next floor of the modular building may be affixed to the floor support 1703. The floor support 1703 may separate each floor of the modular building and a roof may be affixed to the top floor using a roof support 616 as described herein rather than another floor support 1703. An upper portion of the floor support 1703 may be narrower than the lower horizontal elements 350 to create a lip 1706 to contact the floor 1702.

Figure 18:
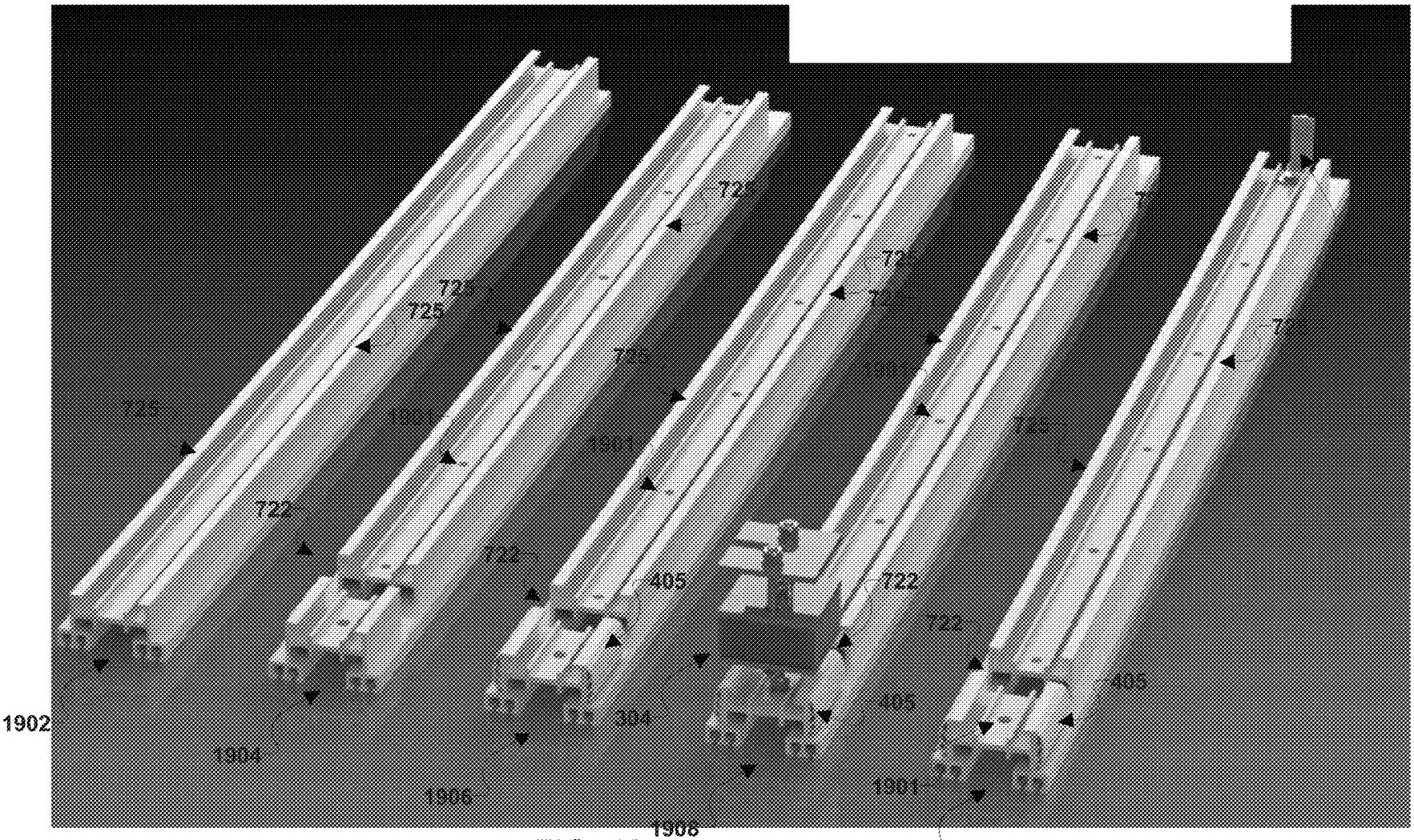
FIG. 18 illustrates different horizontal element configurations according to various embodiments.

FIG. 18 illustrates different horizontal element configurations 1902, 1904, 1906, 1908, and 1910 according to various embodiments. With reference to FIGS. 1A-18, a horizontal element configuration 1902 may be a straight element with no slots 722. In another configuration 1904, the horizontal element may include a slot 722 between a first raised portion and second raised portion and holes 1901 passing through the horizontal element to enable connections to other elements, such as a foundation, etc. In another configuration 1906, the horizontal element may include a panel seal 405 on the first raised portion. In another configuration 1908, the horizontal element may include a shock absorber 304. In another configuration 1910, the horizontal element may include a bracket 1903 at one end. Horizontal elements 1902-1910 may include rail features 725 along their lengthwise directions over which a vertical element and/or panel may be slid and/or that may slide into a vertical element and/or panel. A slot between the rail features 725 may create the channel 316 between the panels and the horizontal elements 1902-1910 when joined together.

Figure 19:
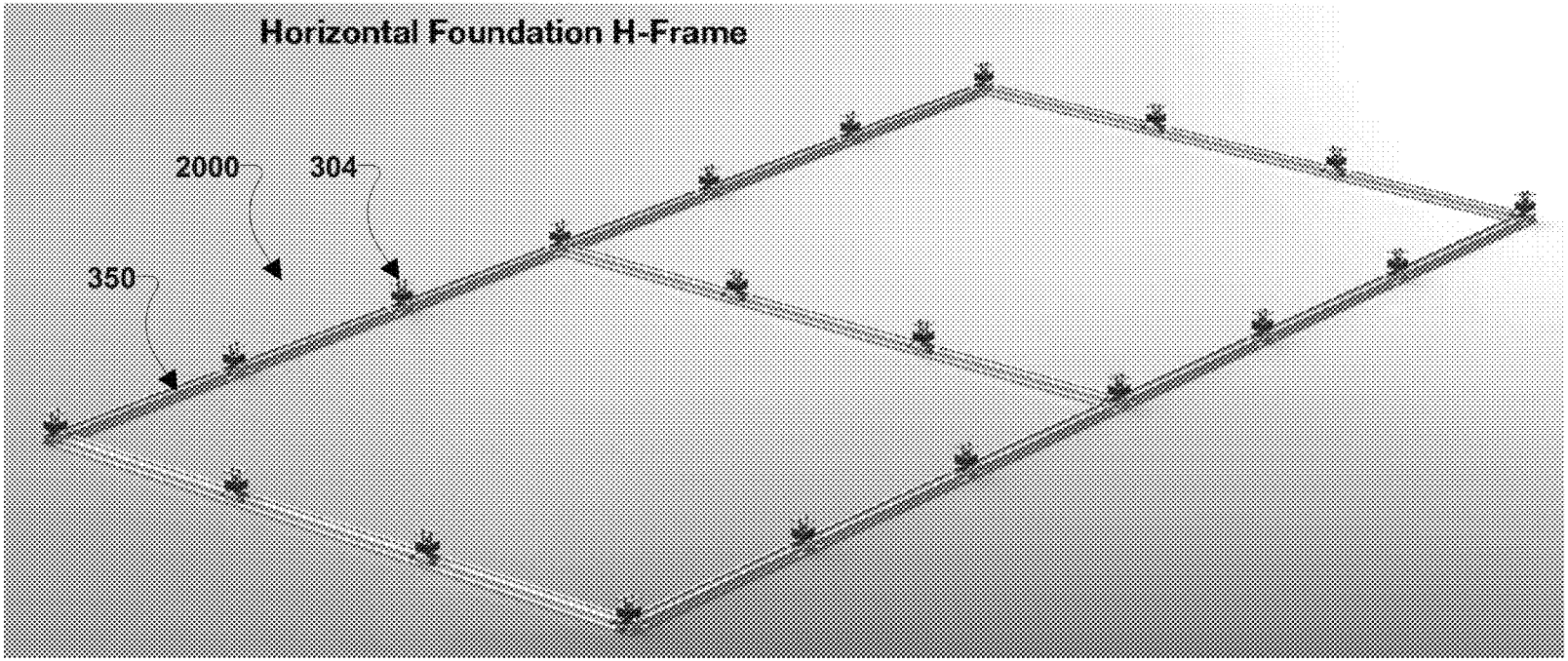
FIG. 19 illustrates horizontal elements arranged into an H-frame suitable for installation on a foundation according to various embodiments.

FIG. 19 illustrates lower horizontal elements 350 arranged into an H-frame 2000 suitable for installation on a foundation or floor. With reference to FIGS. 1A-19, the lower horizontal elements 350 may include shock absorbers 304. Once the H-frame is affixed to the foundation or floor, the vertical elements and panels discussed herein may be slide onto the lower horizontal elements 350 to form the walls of a modular building.

Figure 20:
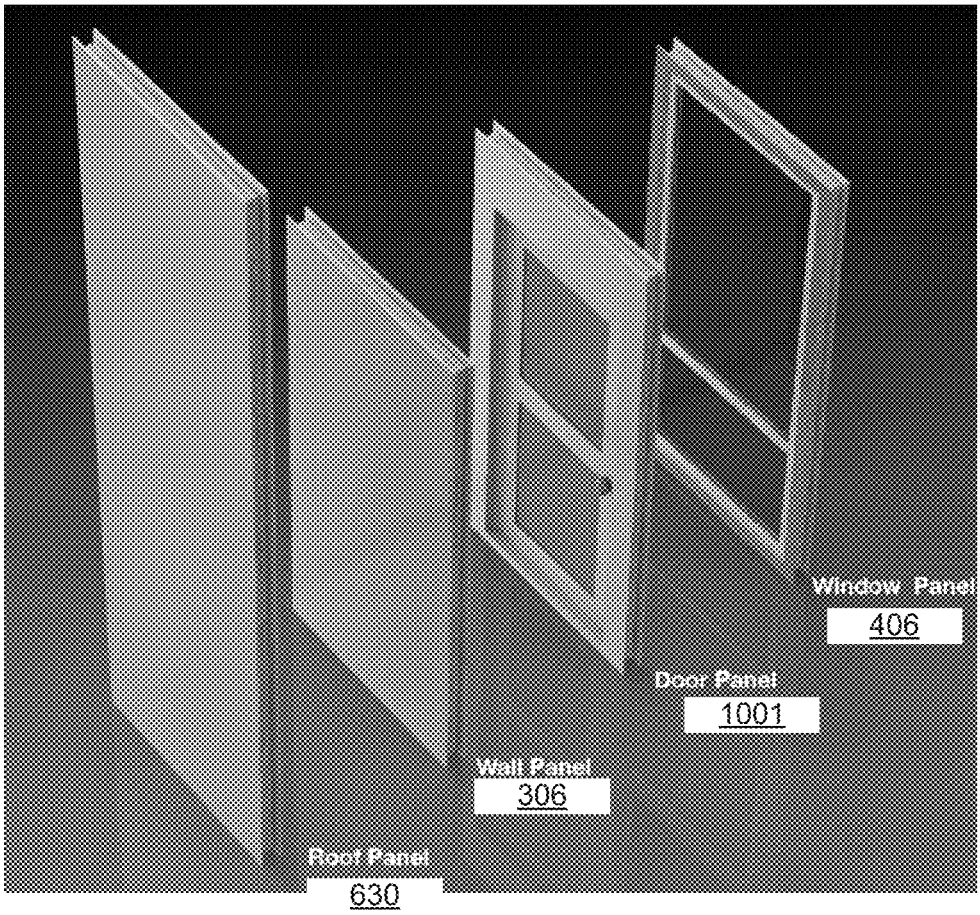
FIG. 20 illustrates various panels according to various embodiments.

FIG. 20 illustrates such example panels according to various embodiments. With reference to FIGS. 1A-20, FIG. 20 illustrates a roof panel 630, a wall panel 306, a door panel 1001, and a window panel 406. The panels slide over the rail features 725 on the lower horizontal elements 350. Similarly, the rail features 725 of the upper horizontal elements 350 slide into the panels. In various embodiments, the roof panel 630, the wall panel 306, the door panel 1001, and/or the window panel 406 may be structural insulated panels (SIPs) formed from a sandwich of ACP or other hard materials and foam.

Figure 21:
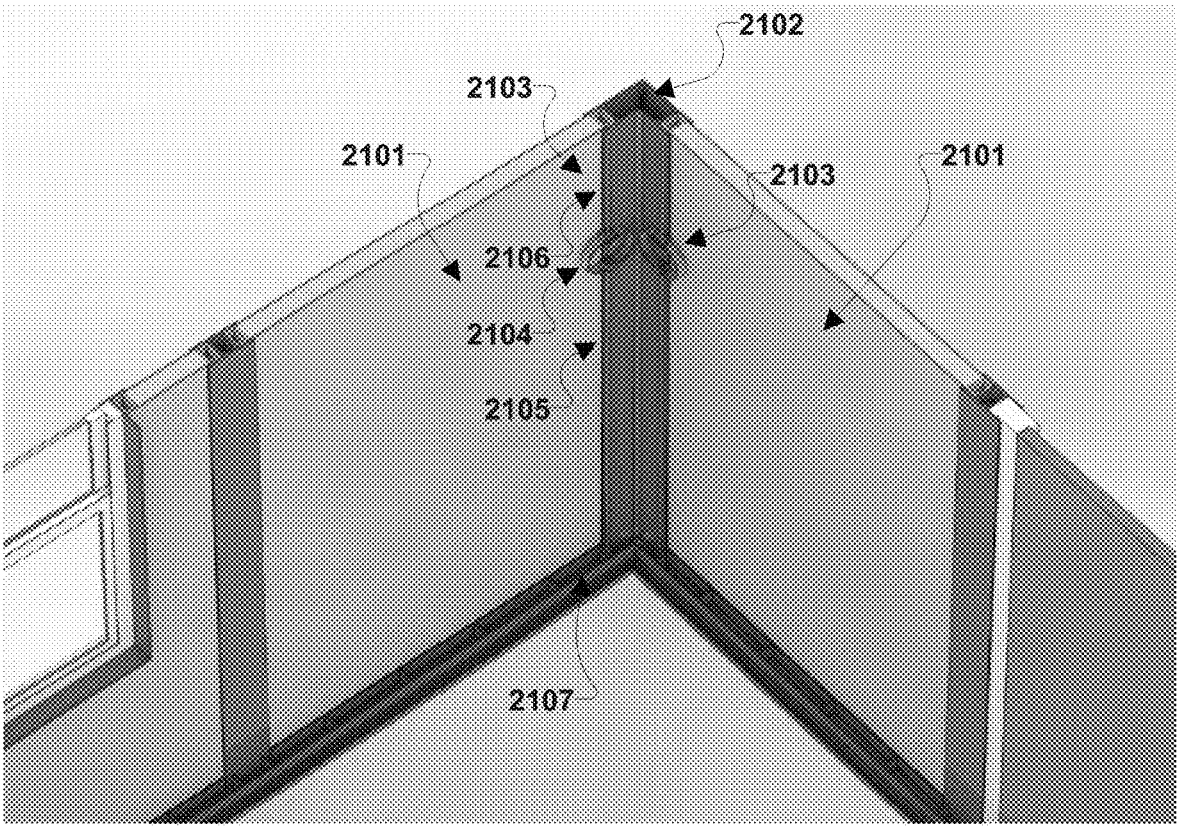
FIG. 21 illustrates a cut-away view a corner portion of a modular building according to various embodiments.

FIG. 21 illustrates a cut-away view a corner portion of a modular building according to various embodiments. With reference to FIGS. 1A-21, FIG. 21 illustrates an embodiment modular building in which separate inside walls are affixed inside of the vertical elements and/or vertical panels (e.g., wall panels, door panels, window panels, etc.). The wall panels 2101 shown in FIG. 21 may be similar to the wall panels 123 and 306 described herein. The vertical element 2102 shown in FIG. 21 may be similar to the vertical element 412 described herein. The lower horizontal element 2107 shown in FIG. 21 may be similar to horizontal element 350 described herein and may further be configured to support the insertion of an inside wall (or inner wall) disposed toward the inside of the modular building affixed to the wall panels 2101. The locking system 2103 may be disposed between the inside wall and the vertical element 2102 and/or wall panels 2101. The locking system 2103 may connect an upper horizontal element to the lower horizontal element 2107. The locking system 2103 between the inside wall and the vertical element 2102 and/or wall panels 2101 may be tensioned to pull the upper horizontal element toward the lower horizontal element to thereby lock vertical elements (e.g., vertical element 2102) and vertical panels (e.g., wall panels 2101) in place between the upper horizontal elements and the lower horizontal element 2107. The locking system 2103 may include an upper lock bar 2106 (or lock rod, cable, etc.) coupled to a lower lock bar 2105 (or lock rod, cable, etc.) by a shock absorber 2104. For example, the shock absorber 2104 may be a metal (e.g., steel, etc.) oval spring, rubber block, hydraulic system, etc. The shock absorber 2104 may operate similar to shock absorber 304 as described herein.

In alternative embodiments, the locking systems as described herein may not interact with the lower horizontal elements 350. Rather, the locking systems may pull the upper horizontal elements 610 toward the foundation and/or floor to thereby lock vertical elements and vertical panels in place between the upper horizontal elements and the foundation and/or floor. For example, lock rod 302 (or lock cable, or other locking mechanism) may connect to a bolt in the foundation on a first level of a modular building and/or lock rod 302 (or lock cable, or other locking mechanism) may connect to a bolt in a floor of a second or higher level of a modular building. The lock rod 302 (or lock cable, or other locking mechanism) may be tensioned during installation to create force holding the modular building walls together.

Figure 22:
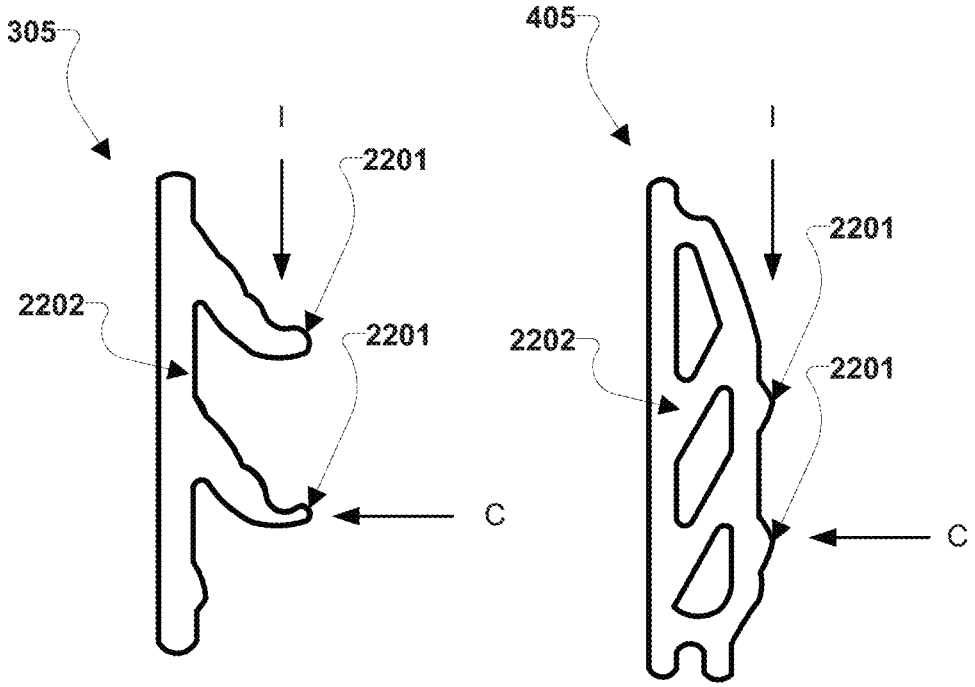
FIG. 22 illustrates cut-away side views of two panel seal configurations according to various embodiments.

FIG. 22 illustrates cut-away side views of two different panel seals 305 and 405. With reference to FIGS. 1A-22, the panel seal 305, 405 may be formed from a compressible material, such a plastic, rubber, or other type material seal, that may act as a weather seal for the joints of the modular building. The panel seal 305, 405 may form a flexible seal between the vertical panels (such as door panels, window panels, wall panels, etc.) and/or roof panels that join to the vertical elements and/or horizontal elements (e.g., lower horizontal elements, upper horizontal elements, roof trusses, etc.). The panel seal 305, 405 may be affixed to the vertical panels (such as door panels, window panels, wall panels, etc.) and/or roof panels, such as by glue, nails, friction, physical arrangement of the surface of the vertical panels (such as door panels, window panels, wall panels, etc.) and/or roof panels, and/or any in any other manner. The presence of the panel seal 305, 405 at the joint connection points may eliminate the need for caulking and/or glue in the modular building. The panel seal 305, 405 may be a flexible seal having one or more raised flexible features 2201 (e.g., lips, wipers, bubbles, etc.) extending from a main body 2202 of the panel seal 305, 405. The raised flexible features 2201 may be compressed toward the main body 2202 (e.g., in the direction "C") when the vertical panels (such as door panels, window panels, wall panels, etc.), roof panels, vertical elements and/or horizontal elements (e.g., lower horizontal elements, upper horizontal elements, roof trusses, etc.) are joined together (e.g., by being inserted in the direction "I"). The compression of the raised flexible features 2201 may form compression interlocks between the vertical panels (such as door panels, window panels, wall panels, etc.) and/or roof panels that join to the vertical elements and/or horizontal elements (e.g., lower horizontal elements, upper horizontal elements, roof trusses, etc.). In various embodiments, the raised flexible features 2201 may be compressed to lie flat against the main body 2202 when the structural elements of the modular building (e.g., the vertical panels (such as door panels, window panels, wall panels, etc.), roof panels, vertical elements and/or horizontal elements (e.g., lower horizontal elements, upper horizontal elements, roof trusses, etc.)) are joined together. Additionally, the raised flexible features 2201 may mold to the mating surface of the structural elements of the modular building (e.g., the vertical panels (such as door panels, window panels, wall panels, etc.), roof panels, vertical elements and/or horizontal elements (e.g., lower horizontal elements, upper horizontal elements, roof trusses, etc.)) when the structural elements are joined together. The flexibility of the panel seal 305, 405 may compensate for tolerance variations in the profiles of the vertical panels (such as door panels, window panels, wall panels, etc.), roof panels, vertical elements and/or horizontal elements (e.g., lower horizontal elements, upper horizontal elements, roof trusses, etc.), especially when such structural elements of the modular building are formed from FRP. As the vertical panels (such as door panels, window panels, wall panels, etc.), roof panels, vertical elements and/or horizontal elements (e.g., lower horizontal elements, upper horizontal elements, roof trusses, etc.) are joined together, the panel seal 305, 405 may compress (e.g., the raised flexible features 2201 may compress toward the main body 2202 in the direction "C", and/or the main body 2202 may compress in the direction "C") and the compression may provide the required tolerances for the structural elements of the modular building to fit together, as well as may act as a shock absorber between the structural elements. This compression of the panel seal 305, 405 may make the structural elements of the modular building (e.g., the vertical panels (such as door panels, window panels, wall panels, etc.), roof panels, vertical elements and/or horizontal elements (e.g., lower horizontal elements, upper horizontal elements, roof trusses, etc.)) easier to fit together. Additionally, by compensating for tolerance variation in the structural elements of the modular building (e.g., the vertical panels (such as door panels, window panels, wall panels, etc.), roof panels, vertical elements and/or horizontal elements (e.g., lower horizontal elements, upper horizontal elements, roof trusses, etc.)), this compression of the panel seal 305, 405 may prevent modular panels from not fitting together at a build site and needing to be shipped back to a supplier due to not fitting. While FIG. 22 illustrates two example configurations of the panel seal 305, 405, other configurations of panel seals, such as other configurations with different shapes of raised features 2201 and main bodies 2202, different numbers of raised features 2201, etc., may be substituted for the panel seals 305 and 405 described herein.

Various aspects illustrated and described are provided merely as examples to illustrate various features of the claims. However, features shown and described with respect to any given aspect are not necessarily limited to the associated aspect and may be used or combined with other aspects that are shown and described. Further, the claims are not intended to be limited by any one example aspect.

The foregoing method descriptions and the process flow diagrams are provided merely as illustrative examples and are not intended to require or imply that the steps of the various aspects must be performed in the order presented. As will be appreciated by one of skill in the art the order of steps in the foregoing aspects may be performed in any order.

Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed aspects is provided to enable any person skilled in the art to make or use the claims. Various modifications to these aspects will be readily apparent to those skilled in the art, and the generic principles defined herein may be applied to other aspects without departing from the scope of the claims. Thus, the claims are not intended to be limited to the aspects described herein but are to be accorded the widest scope consistent with the following claims and the principles and novel features disclosed herein.

What is claimed is:

1. A modular building, comprising:

at least one lower horizontal element;

at least one vertical element configured to form at least one hollow central portion;

at least one upper horizontal element;

at least one locking system connecting the lower horizontal element, the vertical element, and the upper horizontal element together; and a vertical panel joined between the lower horizontal element and the upper horizontal element and joined to the vertical element, wherein a continuous utility channel is formed between the vertical panel and the vertical element providing passage from the lower horizontal element to the upper horizontal element when the vertical panel, lower horizontal element, upper horizontal element, and vertical element are joined together, and wherein the locking system at least partially passes through the vertical element and is under tension to thereby pull the lower horizontal element, the vertical element, and the upper horizontal element together.

2. The modular building of claim 1, wherein the vertical panel is a wall panel, a window panel, or a door panel.

3. The modular building of claim 1, wherein the vertical panel includes a panel seal encircling the vertical panel.

4. The modular building of claim 2, wherein the panel seal is a rubber seal or a plastic seal.

5. The modular building of claim 1, wherein the vertical element, the upper horizontal element, or the lower horizontal element are comprised of fiber reinforced plastic.

6. The modular building of claim 5, wherein the vertical panel comprises aluminum composite panels with foam sandwiched therebetween.

7. The modular building of claim 1, wherein the vertical panel comprises a structural insulated panel.

8. A modular building, comprising:

at least one lower horizontal element;

at least one vertical element configured to form at least one hollow central portion;

at least one upper horizontal element;

at least one locking system connecting the lower horizontal element, the vertical element, and the upper horizontal element together; and a vertical panel joined between the lower horizontal element and the upper horizontal element and joined to the vertical element, wherein a continuous utility channel is formed between the vertical panel and the vertical element providing passage from the lower horizontal element to the upper horizontal element when the vertical panel, lower horizontal element, upper horizontal element, and vertical element are joined together, and wherein the locking system comprises a shock absorber connected between the lower horizontal element and a lock rod, bar, or cable of the locking system and includes a fastener affixing the shock absorber to the lower horizontal element, the fastener separated from the lock rod, bar, or cable of the locking system by the shock absorber.

9. The modular building of claim 8, wherein the shock absorber comprises a rubber block, spring, or hydraulic system connected to the lock rod, bar, or cable of the locking system.

10. The modular building of claim 1, wherein the vertical element, the upper horizontal element, or the lower horizontal element are joined to the vertical panel without using fasteners.

11. A modular building, comprising:

at least one lower horizontal element;

at least one vertical element configured to form at least one hollow central portion;

at least one upper horizontal element;

at least one locking system connecting the lower horizontal element, the vertical element, and the upper horizontal element together; and a vertical panel joined between the lower horizontal element and the upper horizontal element and joined to the vertical element, wherein a continuous utility channel is formed between the vertical panel and the vertical element providing passage from the lower horizontal element to the upper horizontal element when the vertical panel, lower horizontal element, upper horizontal element, and vertical element are joined together, and wherein structural elements of the modular building are held together without glue or caulk.

12. The modular building of claim 1, further comprising:

a roof support affixed to the upper horizontal element; and at least one roof panel affixed to the roof support.

13. A locking system for a modular building, comprising:

a shock absorber; and a locking element connected to the shock absorber, wherein:

the shock absorber and locking element together connect an upper element of the modular building to a foundation or a lower horizontal element of the modular building and pull the upper element toward the foundation or the lower horizontal upper element and the foundation or the lower horizontal element; and the shock absorber is connected:

between the foundation or the lower horizontal element of the modular building and the locking element; or between the upper element of the modular building and the locking element.

14. The locking system of claim 13, wherein the shock absorber comprises a rubber block, hydraulic system, or spring.

15. The locking system of claim 13, wherein the shock absorber and locking element are disposed within a hollow central portion of the vertical element such that the shock absorber separates the locking element from the foundation or the lower horizontal element of the modular building or separates the locking element from the upper element of the modular building.

16. The locking system of claim 13, wherein the shock absorber and locking element are disposed between the vertical panel and an inside wall.

17. The locking system of claim 13, wherein the locking element is a lock bar, rod, or cable.

18. The locking system of claim 13, wherein the vertical panel is a wall panel, a window panel, or a door panel.

19. The locking system of claim 13, wherein the upper element is an upper horizontal element of the modular building.

20. The locking system of claim 13, wherein the vertical element, the upper element, or the lower horizontal element are comprised of fiber reinforced plastic.

21. The locking system of claim 13, wherein the vertical panel comprises aluminum composite panels with foam sandwiched therebetween.

22. The locking system of claim 13, wherein the vertical panel comprises a structural insulated panel.

23. The locking system of claim 13, wherein the vertical element, the upper element, or the lower horizontal element are joined to the vertical panel without using fasteners.

24. The locking system of claim 13, wherein the locking system holds structural elements of the modular building together without glue or caulk.

25. A modular building kit, comprising:

at least one lower horizontal element;

at least one vertical element configured to form at least one hollow central portion;

at least one upper horizontal element; and at least one locking system configured to connect the lower horizontal element, the vertical element, and the upper horizontal element together, wherein the locking system comprises:

a locking element; and a shock absorber configured to be connected between the lower horizontal element and the locking element or connected between the upper horizontal element and the locking element.

26. The kit of claim 25, further comprising a vertical panel configured to be joined between the lower horizontal element and the upper horizontal element and to be joined to the vertical panel.

27. The kit of claim 26, wherein the vertical panel is a wall panel, a window panel, or a door panel.

28. The kit of claim 27, wherein the vertical panel includes a panel seal encircling the vertical panel.

29. The kit of claim 28, wherein the panel seal is a rubber seal or a plastic seal.

30. The kit of claim 26, wherein the vertical panel comprises aluminum composite panels with foam sandwiched therebetween.

31. The kit of claim 26, wherein the vertical panel comprises a structural insulated panel.

32. The kit of claim 25, further comprising:

a roof support;

a roof panel;

a floor support; and a floor portion, wherein the locking system is configured such that the roof panel moves during a negative pressure spike when the lower horizontal element, the vertical element, the upper horizontal element, and roof panel are connected together to form a modular building.

33. The kit of claim 25, wherein the vertical element, the upper horizontal element, or the lower horizontal element are comprised of fiber reinforced plastic.

34. The modular building of claim 1, further comprising utilities located in the continuous utility channel and extending continuously from the lower horizontal element to the upper horizontal element between the vertical panel and the vertical element.

35. The modular building of claim 33, wherein the utilities include data lines, plumbing lines, electrical lines or wiring, or heating, ventilation, and air conditioning (HVAC) ducting.

36. A modular building, comprising:

at least one lower horizontal element;

at least one vertical element configured to form at least one hollow central portion;

at least one upper horizontal element;

at least one locking system connecting the lower horizontal element, the vertical element, and the upper horizontal element together;

a vertical panel joined between the lower horizontal element and the upper horizontal element and joined to the vertical element, wherein a continuous utility channel is formed between the vertical panel and the vertical element providing passage from the lower horizontal element to the upper horizontal element when the vertical panel, lower horizontal element, upper horizontal element, and vertical element are joined together; and utilities located in the continuous utility channel and extending continuously from the lower horizontal element to the upper horizontal element between the vertical panel and the vertical element, wherein the locking system comprises:

a shock absorber connected between the lower horizontal element and a lock rod, bar, or cable of the locking system, a catch plate affixed to the lock rod, bar, or cable of the locking system;

a first fastener passing through the rubber block and lower plate, the first fastener connected to the upper plate and the lower horizontal element; and a second fastener passing through the rubber block and the upper plate, the second fastener connected to the lower plate and the catch plate.

37. The modular building of claim 8, wherein the lock rod, bar, or cable of the locking system connects to a catch plate connected to the shock absorber and the shock absorber is configured to expand and contract between the lower horizontal element and the lock rod, bar, or cable of the locking system to dampen a force acting on the vertical element.

38. The locking system of claim 13, further comprising a catch plate connecting the locking element to the shock absorber.

39. The locking system of claim 13, wherein the shock absorber is configured to dampen a force acting on the vertical element by:

expanding and contracting between the locking element and the foundation or the lower horizontal element of the modular building; or expanding and contracting between the locking element and the upper element of the modular building.

40. The locking system of claim 13, wherein the shock absorber comprises a rubber block between an upper plate and a lower plate, the rubber block configured to expand and contract between the upper plate and the lower plate.

41. The kit of claim 25, wherein the locking system further comprises a catch plate configured to connect the locking element to the shock absorber.

42. The kit of claim 25, wherein the shock absorber is configured to expand and contract between the lower horizontal element and the locking element when connected between the lower horizontal element and the locking element or expand and contract between the upper horizontal element and the locking element when connected between the upper horizontal element and the locking element.

43. The kit of claim 25, wherein the shock absorber comprises a rubber block between an upper plate and a lower plate, the rubber block configured to expand and contract between the upper plate and the lower plate.

* * * * *